US011718490B2

(12) United States Patent
Yasutaka

(10) Patent No.: US 11,718,490 B2
(45) Date of Patent: Aug. 8, 2023

(54) PAPER SHEET STORAGE DEVICE AND PAPER SHEET PROCESSING DEVICE

(71) Applicant: JAPAN CASH MACHINE CO., LTD., Osaka (JP)

(72) Inventor: Hirokazu Yasutaka, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 291 days.

(21) Appl. No.: 17/256,216

(22) PCT Filed: Mar. 6, 2019

(86) PCT No.: PCT/JP2019/008800

§ 371 (c)(1),
(2) Date: Dec. 27, 2020

(87) PCT Pub. No.: WO2020/003617

PCT Pub. Date: Jan. 2, 2020

(65) Prior Publication Data

US 2021/0261363 A1 Aug. 26, 2021

(30) Foreign Application Priority Data

Jun. 28, 2018 (JP) ..... 2018-123018

(51) Int. Cl.
*B65H 31/24* (2006.01)
*B65H 1/14* (2006.01)
(Continued)

(52) U.S. Cl.
CPC ..... *B65H 1/14* (2013.01); *B65H 29/006* (2013.01); *B65H 31/24* (2013.01); *B65H 43/06* (2013.01);
(Continued)

(58) Field of Classification Search
CPC ..... B65H 31/24; B65H 2301/41912; B65H 2405/1117; B65H 2701/1912; G07D 11/13
See application file for complete search history.

(56) References Cited

U.S. PATENT DOCUMENTS 5,491,540 A * 2/1996 Hirst ..... G03G 15/0865 399/12
5,548,374 A * 8/1996 Iguchi ..... G03G 15/55 399/24
(Continued)

FOREIGN PATENT DOCUMENTS

CN 103282947 A 9/2013
CN 105427482 A 3/2016
(Continued)

OTHER PUBLICATIONS

AU Examination report No. 2 for standard patent application dated Sep. 24, 2021 in AU2019294647 (4 pages).
(Continued)

*Primary Examiner* — Howard J Sanders
(74) *Attorney, Agent, or Firm* — Masuvalley & Partners; Peter R. Martinez

(57) ABSTRACT

The present invention makes it possible to perform both judgment of necessity of maintenance of a circulation-type paper sheet storage device and the maintenance of the circulation-type paper sheet storage device in the same place. The paper sheet storage device is a paper sheet storage device attached to a paper sheet processing device having a storage function for receiving paper sheets transported thereto and storing the paper sheets in the paper sheet storage device and/or a feeding function for feeding paper sheets stored in the paper sheet storage device. The paper sheet storage device includes a memory unit that memorizes
(Continued)

therein specific information to be updated according to storage or feed of paper sheets.

4 Claims, 10 Drawing Sheets

(51) Int. Cl.

| | |
|---|---|
| ***G07D 11/13*** | (2019.01) |
| ***B65H 29/00*** | (2006.01) |
| ***B65H 43/06*** | (2006.01) |
| ***B65H 83/02*** | (2006.01) |

(52) U.S. Cl.
CPC ..... *B65H 83/025* (2013.01); *G07D 11/13* (2019.01); *B65H 2301/41912* (2013.01); *B65H 2405/1117* (2013.01); *B65H 2701/1912* (2013.01)

(56) References Cited

U.S. PATENT DOCUMENTS

| | | | | |
|---|---|---|---|---|
| 6,350,029 | B1 | 2/2002 | Szlucha et al. | |
| 6,701,096 | B2 * | 3/2004 | Arai | B41J 2/17566 399/12 |
| 9,141,876 | B1 | 9/2015 | Jones et al. | |
| 9,886,807 | B2 * | 2/2018 | Takami | G07D 11/12 |
| 2007/0122023 | A1 | 5/2007 | Jenrick et al. | |
| 2008/0128240 | A1 | 6/2008 | Uemizo et al. | |
| 2012/0323361 | A1 | 12/2012 | Brexel et al. | |
| 2013/0256091 | A1 | 10/2013 | Kagoshima et al. | |
| 2017/0046673 | A1 | 2/2017 | Shibata et al. | |
| 2017/0206729 | A1 | 7/2017 | Blythin et al. | |
| 2017/0309133 | A1 | 10/2017 | Okamoto et al. | |
| 2018/0025570 | A1 | 1/2018 | Nishida et al. | |
| 2018/0047240 | A1 | 2/2018 | Kawamoto et al. | |
| 2018/0144317 | A1 | 5/2018 | Murakami | |
| 2022/0101076 | A1 * | 3/2022 | Vijayan | G03G 15/5079 |

FOREIGN PATENT DOCUMENTS

| | | | |
|---|---|---|---|
| CN | 106233342 | A | 12/2016 |
| CN | 106537470 | A | 3/2017 |
| CN | 106663351 | A | 5/2017 |
| EP | 1 598 787 | B | 8/2013 |
| EP | 2524359 | B1 | 3/2018 |
| JP | H1027274 | A | 1/1998 |
| JP | 2018013892 | A | 1/2018 |
| JP | 2018045342 | A | 3/2018 |
| TW | 200629177 | A | 8/2006 |
| TW | 201602968 | A | 1/2016 |
| TW | 201807669 | A | 3/2018 |
| WO | WO-2012/014276 | A1 | 2/2012 |

OTHER PUBLICATIONS

WIPO, Japan Patent Office International Search Authority, International Search Report (with English translation) and Written Opinion dated Jun. 4, 2019 in International Patent Application No. PCT/JP2019/008800, 6 pages.
RU Office Action issued in RU2020135284 dated Jul. 12, 2021 (6 pages).
CNIPA, Chinese Office Action issued in CN201980041341.4 dated Dec. 5, 2022. (7 pages).
EPO, extended European search report issued in EP19826364.2 dated Nov. 2, 2022. (62 pages).

* cited by examiner

FIG.6(a)

SPECIFIC INFORMATION Ja

| NAME | | CONTENT |
|---|---|---|
| MODEL INFORMATION | | xxxxx |
| UNIT ID | | 1234 |
| SOFTWARE VERSION | | Ver1.0 |
| SET DENOMINATION | DRUM41 | DENOMINATION A |
| | DRUM45 | DENOMINATION B |
| MAXIMUM NUMBER OF SHEETS | DRUM41 | 30 SHEETS |
| | DRUM45 | 30 SHEETS |
| NUMBER OF SHEETS HELD | DRUM41 | 10 SHEETS |
| | DRUM45 | 12 SHEETS |
| MOTOR SPEED | DRUM41 | yyy |
| | DRUM45 | yyy |
| NUMBER OF DRIVES | DRUM41 | 100 TIMES |
| | DRUM45 | 120 TIMES |
| NUMBER OF REJECTS | | 15 TIMES |
| STANDARD LIGHT QUANTITY | SENSOR100a | zzz |
| | SENSOR100b | zzz |
| MEASURED LIGHT QUANTITY | SENSOR100a | zzz |
| | SENSOR100b | zzz |
| ERROR INFORMATION | | 2 TIMES |

FIG.6(b)

SPECIFIC INFORMATION Jb

| NAME | | CONTENT |
|---|---|---|
| MODEL INFORMATION | | xxxxx |
| UNIT ID | | 5678 |
| SOFTWARE VERSION | | Ver1.0 |
| SET DENOMINATION | DRUM61 | DENOMINATION C |
| | DRUM65 | DENOMINATION D |
| MAXIMUM NUMBER OF SHEETS | DRUM61 | 30 SHEETS |
| | DRUM65 | 30 SHEETS |
| NUMBER OF SHEETS HELD | DRUM61 | 9 SHEETS |
| | DRUM65 | 3 SHEETS |
| MOTOR SPEED | DRUM61 | yyy |
| | DRUM65 | yyy |
| NUMBER OF DRIVES | DRUM61 | 90 TIMES |
| | DRUM65 | 15 TIMES |
| NUMBER OF REJECTS | | 15 TIMES |
| STANDARD LIGHT QUANTITY | SENSOR100f | zzz |
| | SENSOR100g | zzz |
| MEASURED LIGHT QUANTITY | SENSOR100f | zzz |
| | SENSOR100g | zzz |
| ERROR INFORMATION | | 3 TIMES |

FIG.10

■ SPECIFIC INFORMATION Jx

| NAME | | | CONTENT |
|---|---|---|---|
| MODEL INFORMATION | | | xxxxx |
| UNIT ID | | | 1234 |
| SOFTWARE VERSION | | | Ver1.0 |
| SET DENOMINATION | | FIRST | DENOMINATION A |
| | | SECOND | DENOMINATION B |
| MAXIMUM NUMBER OF SHEETS | | FIRST | 30 SHEETS |
| | | SECOND | 30 SHEETS |
| NUMBER OF SHEETS HELD | | FIRST | 10 SHEETS |
| | | SECOND | 12 SHEETS |
| STANDARD LIGHT QUANTITY | NEAR-FULL SENSOR | FIRST | zzz |
| | | SECOND | zzz |
| | END SENSOR | FIRST | zzz |
| | | SECOND | zzz |
| MEASURED LIGHT QUANTITY | NEAR-FULL SENSOR | FIRST | zzz |
| | | SECOND | zzz |
| | END SENSOR | FIRST | zzz |
| | | SECOND | zzz |
| ERROR INFORMATION | | | 2 TIMES |

FIG.11

■ SEQUENCE INFORMATION

| Add | a00 | a01 | a02 | a03 | a04 | a05 | | a28 | a29 | |
|---|---|---|---|---|---|---|---|---|---|---|
| | A | A | C | A | Null | Null | ··· | Null | Null | ja |

| Add | b00 | b01 | b02 | b03 | b04 | b05 | | b28 | b29 | |
|---|---|---|---|---|---|---|---|---|---|---|
| | A | C | C | A | B | Null | ··· | Null | Null | jb |

| Add | c00 | c01 | c02 | c03 | c04 | c05 | c06 | | c29 | |
|---|---|---|---|---|---|---|---|---|---|---|
| | C | B | A | A | A | B | Null | ··· | Null | jc |

| Add | b00 | b01 | b02 | b03 | b04 | b05 | b06 | | d29 | |
|---|---|---|---|---|---|---|---|---|---|---|
| | B | B | A | C | A | A | Null | ··· | Null | jd |

PAPER SHEET STORAGE DEVICE AND PAPER SHEET PROCESSING DEVICE

RELATED APPLICATIONS

This application is the U.S. National Phase of and claims priority to International Patent Application No. PCT/JP2019/008800, International Filing Date Mar. 6, 2019, entitled Paper Sheet Storage Device And Paper Sheet Processing Device; which claims benefit of Japanese Patent Application No. 2018-123018 filed Jun. 28, 2018; both of which are incorporated herein by reference in their entireties.

FIELD

The present invention relates to a paper sheet storage device and a paper sheet processing device.

BACKGROUND

As a banknote processing device installed in a banknote handling device such as a vending machine, a game-medium lending machine in a game hall, a ticket machine, a deposit and withdrawal machine, and a change machine that have a function of providing various articles and services by receiving an input banknote, a circulation-type banknote processing device capable of receiving, storing, and dispensing banknotes of a plurality of denominations has been known.

The circulation-type banknote processing device is equipped with a banknote storage unit for storing banknotes prepared for dispensing beforehand and banknotes input during operation for each denomination, or in a state of mixed denominations.

There are a circulation-type banknote storage unit having a function of storing banknotes and discharging banknotes to outside as the change, and a banknote storage unit for collection (a collection box) that collects all the banknotes in the banknote processing device at the closing time or the like, as the banknote storage unit. These various storage units are often installed in the banknote processing device detachably.

CITATION LIST

Patent Literature

Patent Literature 1: Japanese Patent Application Laid-open No. H10-27274

SUMMARY

Technical Problem

People other than a manager can pass by an installation place of the banknote processing device. Therefore, there has been a problem in crime prevention in performing maintenance of the circulation-type banknote storage unit (for example, replenishment of banknotes) in the installation place of the banknote processing device. Due to the circumstances described above, in the conventional technique, there is a case in which the manager carries the circulation-type banknote storage unit to a management room which the manager can enter, and performs the maintenance of the circulation-type banknote storage unit in the management room.

Information of conditions of storage in the banknote storage unit, that is, denominations, the number of sheets, conditions of storage, and the like of stored banknotes, and information of dispensed banknotes (hereinafter, "specific information") may be necessary for ascertaining necessity of maintenance of the circulation-type banknote storage unit. However, the specific information described above is memorized in a memory device arranged in the banknote processing device in which the circulation-type banknote storage unit is detachably supported. Therefore, in the conventional technique described above, for example, after the specific information memorized in the memory device in the banknote processing device is confirmed, it is necessary to perform the maintenance of the circulation-type banknote storage unit in the management room.

In the conventional technique described above, in a case where the maintenance of the circulation-type banknote storage unit is performed in the management room, a place where a confirmation work of the specific information is performed is different from a place where the maintenance of the circulation-type banknote storage unit is performed. Therefore, there is such a problem that the maintenance of the circulation-type banknote storage unit cannot be performed immediately after the judgment whether it is necessary to perform the maintenance of the circulation-type banknote storage unit based on the specific information. The present invention has been achieved in view of the situation described above, and an object of the present invention is to solve the above problem.

Solution to Problem

In order to achieve the above object, a paper sheet storage device according to the present invention is a paper sheet storage device attached to a paper sheet processing device having a storage function for receiving paper sheets transported thereto and storing the paper sheets in the paper sheet storage device and/or a feeding function for feeding paper sheets stored in the paper sheet storage device, and comprises a memory unit that memorizes therein specific information to be updated according to storage or feed of paper sheets. In the configuration described above, for example, by providing a reader capable of reading the specific information from the memory unit of the paper sheet storage device (banknote storage unit) in a management room, both a work for judging necessity of maintenance of the paper sheet storage device and the maintenance of the paper sheet storage device can be performed in the management room.

Advantageous Effects of Invention

According to the present invention, it is possible to perform both judgment of necessity of maintenance of a circulation-type paper sheet storage device and the maintenance of the circulation-type paper sheet storage device in the same place.

BRIEF DESCRIPTION OF DRAWINGS

FIGS. 6(*a*) and (*b*) are explanatory diagrams of specific information.

FIG. 10 is an explanatory diagram of specific information in the second embodiment.

FIG. 11 is an explanatory diagram of sequence information according to a modification.

DESCRIPTION OF EMBODIMENTS

Figure 1A:
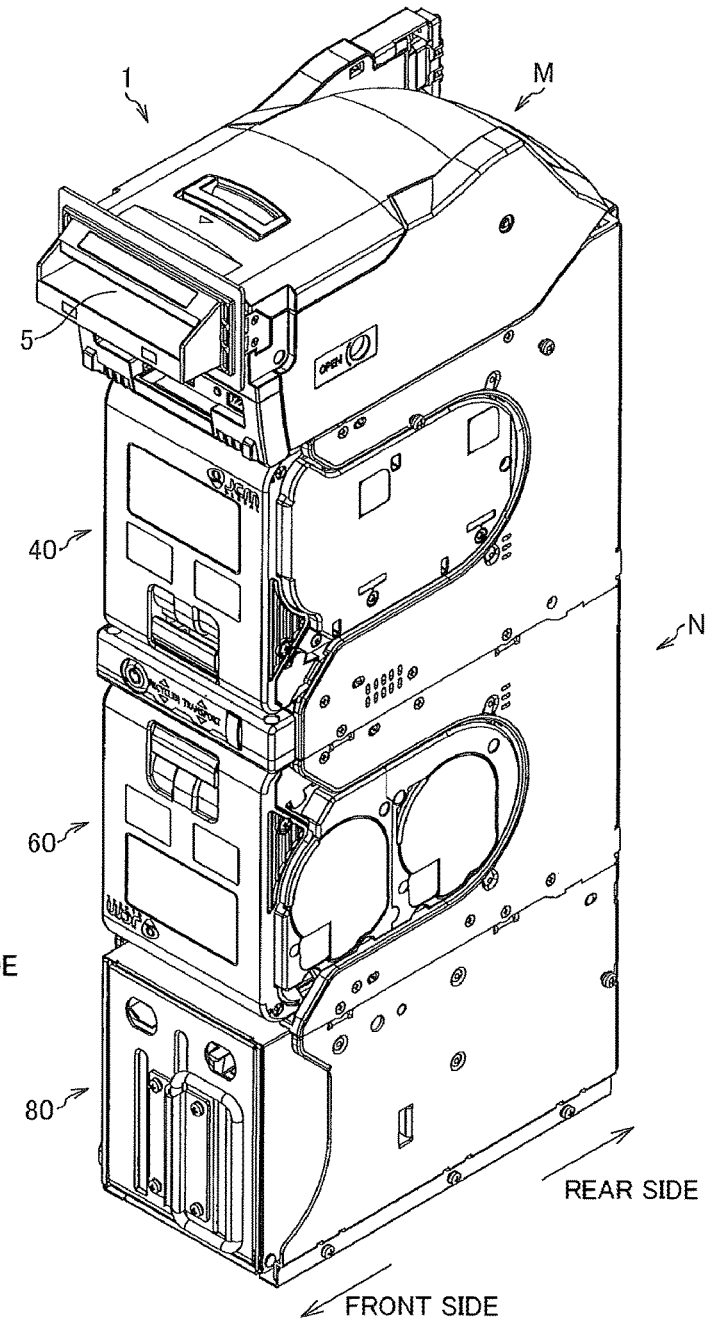
FIGS. 1(*a*) and (*b*) are external perspective views of a banknote processing device and a banknote storage unit.

The present invention is described below in detail based on embodiments illustrated in the drawings.

[Configuration of Banknote Processing Device]

Figure 1B:
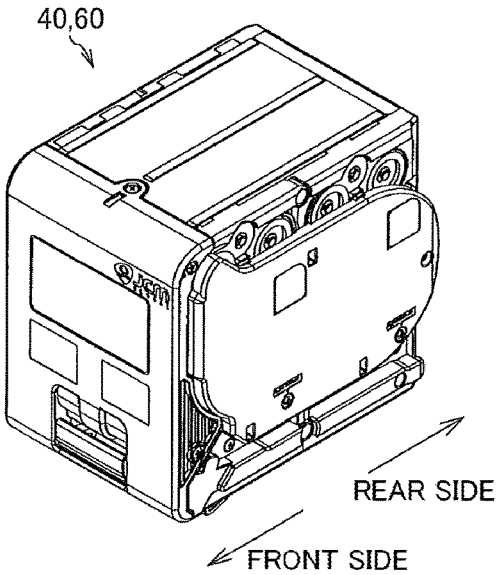
Figure 2A:
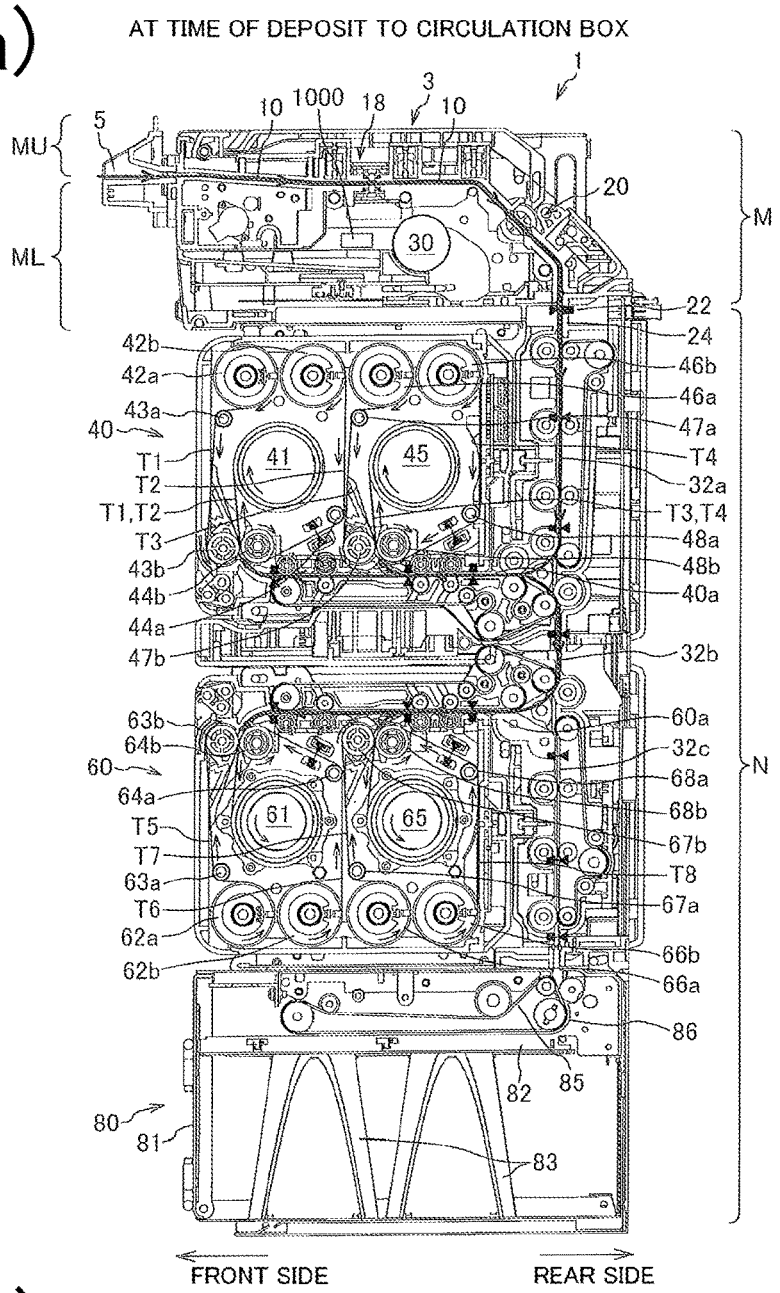
FIGS. 2(*a*) and (*b*) are explanatory diagrams of a deposit operation in the banknote processing device.
Figure 2B:
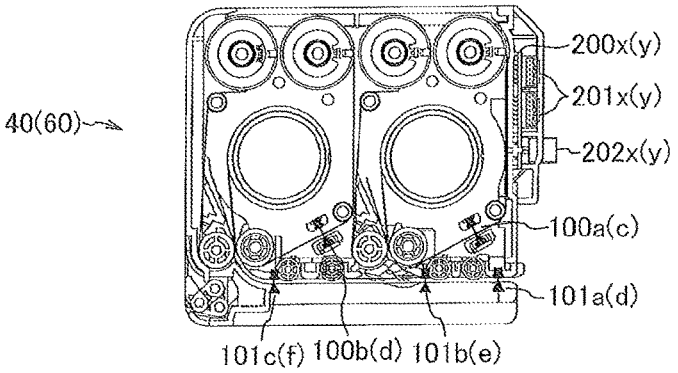
Figure 3:
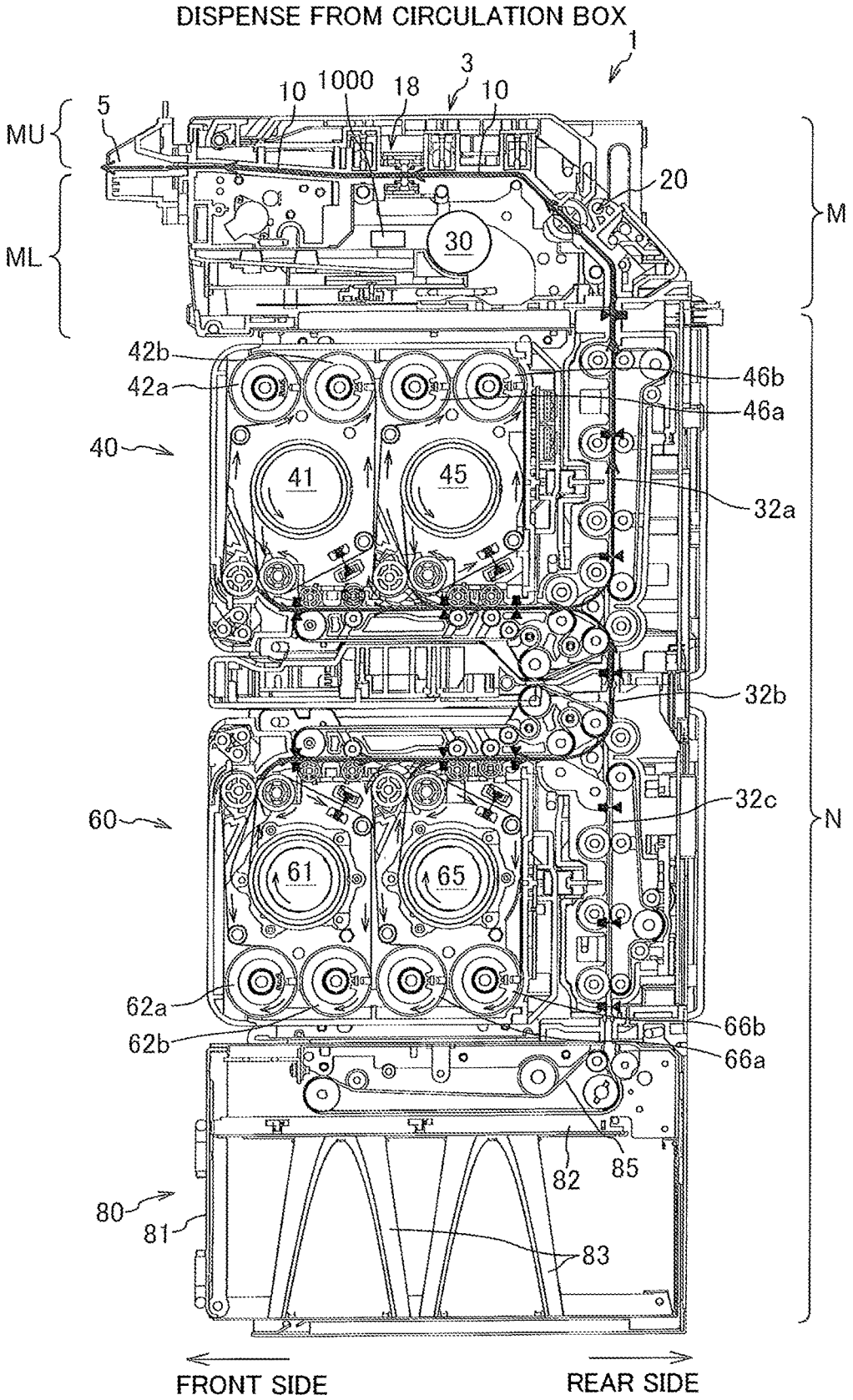
FIG. 3 is an explanatory diagram of a dispense operation in the banknote processing device.
Figure 4:
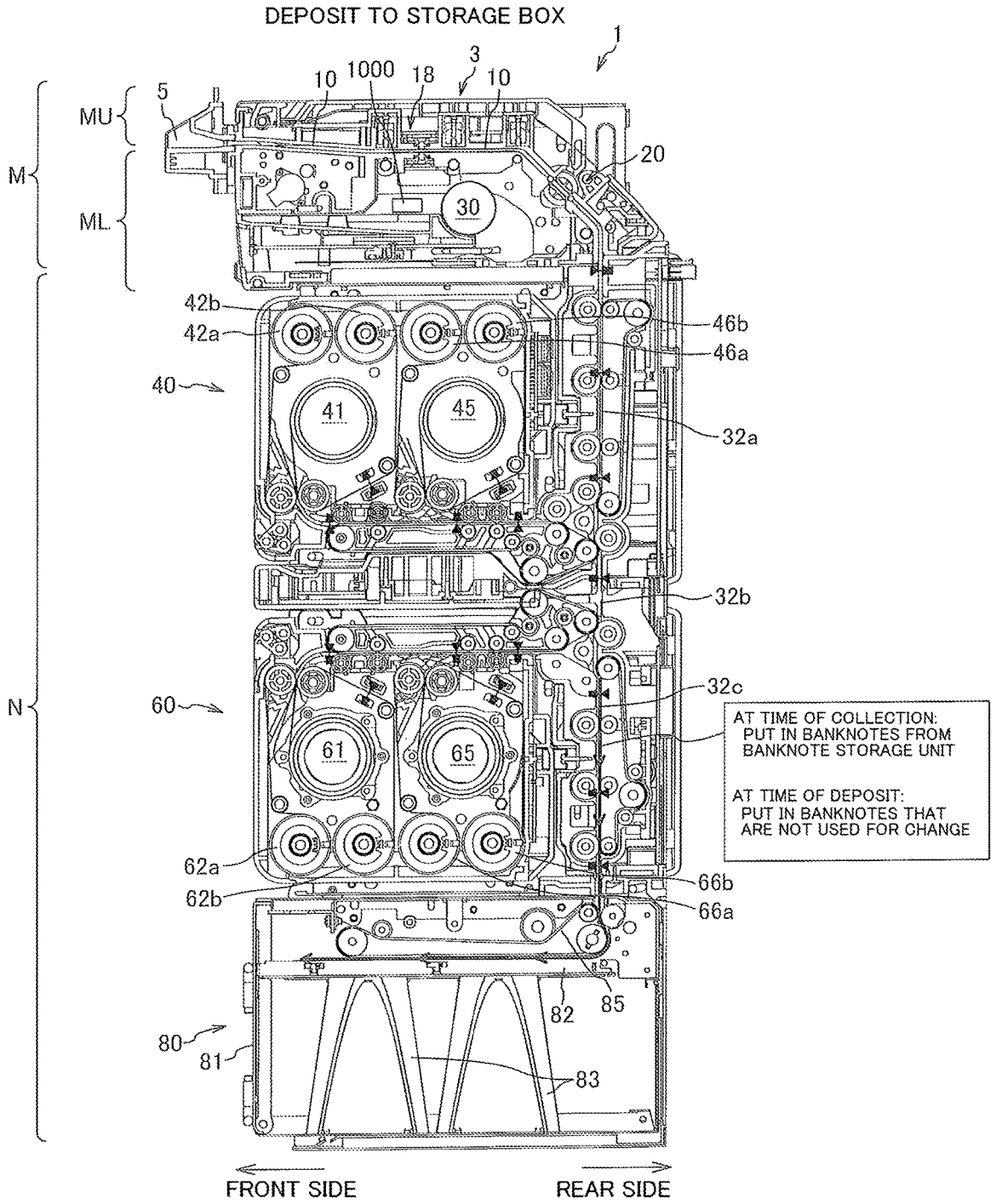
FIG. 4 is an explanatory diagram of a collection operation in the banknote processing device.

FIG. 1(*a*) is an external perspective view of a banknote (paper sheet) processing device including a paper sheet storage unit according to one embodiment of the present invention, and FIG. 1(*b*) is an external perspective view of a single body of the banknote storage unit. FIG. 2(*a*) is a longitudinal sectional view of the banknote processing device and illustrates a flow of banknotes at the time of deposit to the banknote storage unit by an arrow. FIG. 2(*b*) is a longitudinal sectional view of the single banknote storage unit. FIG. 3 is a longitudinal sectional view of the banknote processing device and illustrates a flow of banknotes at the time of dispense from the banknote storage unit by an arrow. FIG. 4 is a longitudinal sectional view of the banknote processing device and illustrates a flow of banknotes at the time of deposit to a collection box by an arrow.

In the present embodiment, a device that processes banknotes as an example of a paper sheet is described. However, the paper sheet storage unit and the paper sheet processing device of the present invention can also be applied to a processing device of general paper sheets such as cash vouchers, tickets, and marketable securities, other than banknotes.

A circulation-type banknote processing device (hereinafter, "banknote processing device") 1 illustrated in FIG. 1 is means that is installed in or together with a banknote handling device, for example, a vending machine, a ticket machine, a game-medium lending machine in a game hall, a deposit and withdrawal machine, or a change machine, for performing processes for receiving banknotes and dispensing banknotes as the change or the like.

The banknote processing device 1 is schematically configured by a casing 3 configuring an exterior body, a deposit and withdrawal processing unit (banknote introducing unit) M that transports banknotes inserted into the casing in a required route to the machine and discharges banknotes to outside, a banknote storage unit N that stores therein banknotes transported from the deposit and withdrawal processing unit M and transfers banknotes between the deposit and withdrawal processing unit M and the banknote storage unit N, a transport mechanism that transports banknotes through various routes, and a control unit (CPU, MPU, ROM, RAM, main memory, or the like) 1000 that controls various control targets.

The deposit and withdrawal processing unit M includes a lower unit ML and an upper unit MU that is supported so as to be able to be opened/closed with respect to the lower unit ML about a shaft provided on the right side. When the respective units illustrated in FIG. 1 are in a closed state, a deposited banknote transport path (transport route) 10 is formed between opposite surfaces of the respective units.

An inlet/outlet 5 that introduces banknotes P to the inside one by one or discharges banknotes therein to outside one by one is provided at one end of the transport route 10. In the inside of the inlet/outlet 5, an inlet paper passage sensor for detecting banknotes and an inlet roller pair (both not illustrated), an optical recognition sensor 18 that reads information for recognizing a denomination and authenticity of banknotes, a fraud prevention mechanism 20 that includes a relay roller pair, a paper passage sensor on an inlet side of the fraud prevention mechanism, an opening/closing member for fraud detection, a fraud prevention motor, and the like (not illustrated), and a paper passage sensor 22 on the side of an outlet 24 of the fraud prevention mechanism are arranged along the transport route 10. Further, a transport motor 30 that drives respective roller pairs for transporting banknotes, the control unit (CPU, MPU, ROM, RAM) 1000 that determines a denomination and authenticity of banknotes based on recognition information from the optical recognition sensor 18, and controls the transport motor 30 and other control targets based on a banknote detection signal from the respective paper passage sensors and an outlet sensor are arranged.

Banknotes discharged from the outlet 24 are transferred to the banknote storage unit N and sorted and stored in the respective storage units according to a difference in the denomination and the like.

The above configuration of the banknote processing device 1 is an example only, and various modifications are possible. For example, the number of motors to be used, arrangement of the transport roller pairs, the type of the recognition sensor, and the like can be variously changed and selected.

The transport roller pairs are each configured by a drive roller arranged on the lower unit ML side and a driven roller arranged on the upper unit MU side, and have a configuration of transporting banknotes by nipping opposite surfaces of the banknote. The optical recognition sensor 18 is a photo coupler that is configured by a light emitting element and a light receiving element arranged to face each other, putting the transport route 10 therebetween, and can recognize an optical pattern (optical characteristics) of the banknote by causing infrared rays generated by the light emitting element to pass through the banknote and receiving the infrared rays by the light receiving element. As the recognition sensor, a magnetic sensor can also be used.

The banknote storage unit N includes first and second banknote storage units (circulation-type banknote storage devices) 40 and 60 that store therein banknotes, which are discharged one by one from the outlet 24 of the deposit and withdrawal processing unit M when reception of deposited banknotes is confirmed and transported on stored banknote transport routes 32*a* and 32*b*, for each denomination so as to be able to put in and out, and a collection box (collected-banknote storage unit) 80 that is detachably attached to a storage space provided below the second banknote storage unit 60 from the front side to collect all the denominations from the respective banknote storage units via a collected banknote transport route 32*c* at the closing time and collect high-denomination banknotes that are not used as the change and excess banknotes that cannot be stored in the respective banknote storage units.

All the storage units 40, 60, and 80 are configured to be able to be attached to and detached from each storage space provided in the banknote processing device 1 from the front side.

The transport mechanism includes the respective transport routes 10, 32*a*, 32*b*, and 32*c*, a motor and a solenoid, and a pulley, a belt, a gate, and the like for generating and transmitting a drive force to transport banknotes along other transport routes.

The control unit 1000 controls control targets such as the deposit and withdrawal processing unit M, the banknote storage unit N, the transport mechanism.

The maximum number of banknotes to be handled by the inlet/outlet 5 is an example only, and such a configuration is also possible that a plurality of banknotes collectively input are separated from one another and taken into the transport route 10.

The first and second banknote storage units 40 and 60 of the present example each include two circulation drums (41, 45, 61, 65) capable of storing banknotes of up to 30 sheets and rotating in forward and reverse directions. The respective circulation drums 41, 45, 61, 65 are of a type suitable for circulation that stores banknotes by putting the banknotes between long tapes (long films) T1 and T2, T3 and T4, T5 and T6, and T7 and T8 that are wound by two tapes on outer peripheries of the respective circulation drums spirally (helically) in an overlapped state. In the present example, each of the circulation drums has a motor arranged thereto, and an operation to wind each of the tapes T1 to T8 around the outer periphery of each circulation drum and feed the tape is performed by rotating each circulation drum (or a bobbin described later) in forward and reverse directions by each motor.

In the present example, the respective circulation drums 41, 45, 61, 65 have a one-to-two correspondence relation with two bobbins, that is, bobbins 42*a* and 42*b*, bobbins 46*a* and 46*b*, bobbins 62*a* and 62*b*, and bobbins 66*a* and 66*b* that can each rotate in forward and reverse directions. The respective bobbins (pair) are configured to rotate in a feeding direction when the corresponding one circulation drum rotates in a winding direction, and rotate in the winding direction when the corresponding one circulation drum rotates in the feeding direction. When the circulation drum is to be rotated in the winding direction, the motor is rotated in the forward direction to drive the circulation drum. Further, when banknotes on the outer periphery of the circulation drum is to be fed out, a reverse driving force from the motor for the circulation drum is switched to the corresponding bobbins and transmitted thereto by using a switching mechanism (not illustrated), so that the bobbins can be rotated in the winding direction.

In the first banknote storage unit 40, the tape T1 fed from the bobbin 42*a* passes rollers 43*a* and 43*b* and is guided to the outer periphery of the drum 41. The tape T2 fed from the bobbin 42*b* passes rollers 44*a* and 44*b* and is guided to the outer periphery of the drum 41. The respective tapes T1 and T2 form a contact travel area in which the respective tapes T1 and T2 overlap on each other just before the drum 41 and travel in the same direction, and a banknote guided to the contact travel area is guided to the outer periphery of the drum 41, while being put between the respective tapes.

The tape T3 fed from the bobbin 46*a* passes rollers 47*a* and 47*b* and is guided to the outer periphery of the drum 45. The tape T4 fed from the bobbin 46*b* passes rollers 48*a* and 48*b* and is guided to the outer periphery of the drum 45. The respective tapes T3 and T4 form a contact travel area just before the drum 45 and a banknote guided to the contact travel area is guided to the outer periphery of the drum 45, while being put between the respective tapes.

In the second banknote storage unit 60, the tape T5 fed from the bobbin 62*a* passes rollers 63*a* and 63*b* and is guided to the outer periphery of the drum 61. The tape T6 fed from the bobbin 62*b* passes rollers 64*a* and 64*b* and is guided to the outer periphery of the drum 61. The respective tapes T5 and T6 form a contact travel area just before the drum 61 and a banknote guided to the contact travel area is guided to the outer periphery of the drum 61, while being put between the respective tapes.

The tape T7 fed from the bobbin 66*a* passes rollers 67*a* and 67*b* and is guided to the outer periphery of the drum 65. The tape T8 fed from the bobbin 66*b* passes rollers 68*a* and 68*b* and is guided to the outer periphery of the drum 65. The respective tapes T7 and T8 form a contact travel area just before the drum 65 and a banknote guided to the contact travel area is guided to the outer periphery of the drum 65, while being put between the respective tapes.

As an example, a procedure of guiding a banknote to the outer periphery of the circulation drum 41 is described. At the time of introducing the banknote, the respective tapes T1 and T2 are in a state of being wound and held spirally (in multiple layers) on the outer periphery of the bobbins 42*a* and 42*b*, and when the circulation drum 41 rotates in the winding direction by driving the motor in the forward direction, the respective bobbins 42*a* and 42*b* rotate in the feeding direction. A banknote introduced into an inlet 40*a* of the first banknote storage unit 40 through the transport route 32*a* and the transport route 32*b* enters between the both rollers 43*b* and 44*b* (the tapes T1 and T2), by a transport direction thereof being switched to the side of rollers 43*b* and 44*b* by a flap (sorting unit) (not illustrated), enters the contact travel area between the both tapes T1 and T2, and is guided to the outer periphery of the circulation drum 41. Adversely, when a banknote stacked on the outer periphery of the circulation drum 41 is to be discharged to outside of the first banknote storage unit 40, the motor is rotated in the reverse direction to rotate the bobbins 42*a* and 42*b* in the winding direction, and the circulation drum 41 is rotated in the feeding direction, to transport the banknote to the deposit and withdrawal processing unit M through the contact travel area between the tapes T1 and T2, and from the inlet 40*a* through the transport routes 32*a* and 32*b*, or toward the collection box (collected-banknote storage unit) 80 through the transport route 32*c*.

The relation between other circulation drums 45, 61, and 65 and the corresponding bobbins 46*a* and 46*b*, bobbins 62*a* and 62*b*, and bobbins 66*a* and 66*b* is the same as the relation between the circulation drum 41 and the bobbins 42*a* and 42*b*, and thus redundant explanations of procedures are omitted.

The collection box (collected-banknote storage unit) 80 includes a banknote loading table 82 supported vertically movably in a casing 81 for loading banknotes thereon, a spring 83 that biases the banknote loading table upward at all times, a transfer belt 85 that transfers banknotes transported from an inlet 86 onto the banknote loading table while the banknotes being in contact with an upper surface of the banknote loading table 82 (an already loaded banknote) on a lower traveling surface thereof, and an elevating arm (not illustrated) that compresses the banknote transferred onto the banknote loading table by a lower surface of the transfer belt against the banknote loading table.

A sensor that detects passage of the banknotes is each arranged in a proper place of the respective transport routes 32*a*, 32*b*, and 32*c* and in the respective banknote storage units 40 and 60, and is illustrated as a light emitting sensor in a black triangular shape and a light receiving sensor in a black square shape.

A tape full empty sensor arranged in the respective banknote storage units 40 and 60 is means for reading information indicated by a mark described in the tape that passes between the light emitting element and the light receiving element, in the present example, a full state and an empty state of the tape.

[Various Operations of Banknote Processing Device]

Next, an outline of a deposit operation, a dispense operation, and a collection operation of the banknote processing device 1 illustrated in FIG. 1 is described with reference to FIG. 2 to FIG. 4.

That is, FIG. 2, FIG. 3, and FIG. 4 are each explanatory diagrams of the deposit operation, the dispense operation, and the collection operation of the banknote processing device.

First, in the deposit operation illustrated in FIG. 2, when one banknote is input from the inlet/outlet port 5, the control unit 1000 having received a signal from the sensor that has detected the banknote activates the transport mechanism to take in the banknote by using the transport route 10. The banknote having been taken in is moved to the optical recognition sensor 18 and subjected to recognition. The banknote determined to be acceptable by the optical recognition sensor 18 passes through the fraud prevention mechanism 20 and transported from the outlet 24 to the banknote storage unit N.

Further, in the deposit operation, when the banknote is determined to be unacceptable by the optical recognition sensor 18, a reject operation is performed. In the reject operation, the respective drums in the banknote processing device 1 (including the first banknote storage unit 40 and the second banknote storage unit 60) are driven, so that a banknote determined to be unacceptable is transported to the inlet/outlet 5, and is discharged to outside of the banknote processing unit 1.

In the banknote storage unit N, banknotes to be used as the change are stored in any of the banknote storage units 40 and 60 for each denomination via the stored banknote transport routes 32*a* and 32*b*, and banknotes not to be used as the change are stored in the collection box 80 via the transport routes 32*b* and 32*c*.

In the dispense operation in FIG. 3, at the time of dispensing banknotes as the change, the banknotes stored in the banknote storage units 40 and 60 are taken out, and in a case where the banknotes can be returned, the banknotes are dispensed from the inlet/outlet 5. In the collection operation in FIG. 4, at the closing time or the like, banknotes stored in the banknote storage units (circulation-type banknote storage devices) 40 and 60 are stored in the collection box 80 via the transport routes 32*b* and 32*c*.

[Banknote Storage Unit Including Memory]

As illustrated in FIG. 2(*b*) described above, the first banknote storage unit 40 and the second banknote storage unit 60 (hereinafter, these units may be collectively referred to as "banknote storage unit") are provided with various sensors 101(*a, b, c, d, e*, and *f*) that detect a banknote passing through a specific position in the transport route, in addition to the tape full empty sensors 100(*a, b, c*, and *d*).

In each of the banknote storage units, a memory board 200 is provided as illustrated in FIG. 2(*b*). The memory board 200 includes a memory board 200*x* and a memory board 200*y*. The memory board 200*x* is provided in the first banknote storage unit 40 and the memory board 200*y* is provided in the second banknote storage unit 60. An individual memory 201 and a connector 202 are mounted on the memory board 200. The connector 202 in the banknote storage unit is inserted into a connector 305 described later (see FIG. 5) in a state where a banknote from the deposit and withdrawal processing unit M can be transported to the banknote storage unit (in a state where the banknote storage unit is attached), to be electrically connected with the control unit 1000 of the deposit and withdrawal processing unit M.

The individual memory 201 memorizes therein various pieces of information (specific information J described later) in a non-volatile manner. The various pieces of information in the individual memory 201 in the banknote storage unit is referred to by a manager, for example, in order to judge the necessity of the maintenance of the banknote storage unit. As the individual memory 201, for example, a flash memory is preferably adopted. The control unit 1000 updates the information memorized in the individual memory 201 at various moments. Although the flash memory is exemplified as the individual memory 201 to be provided in the memory board 200, another type of memory unit may be adopted as the individual memory 201. For example, an EEPROM may be adopted as the individual memory 201.

Figure 5A:
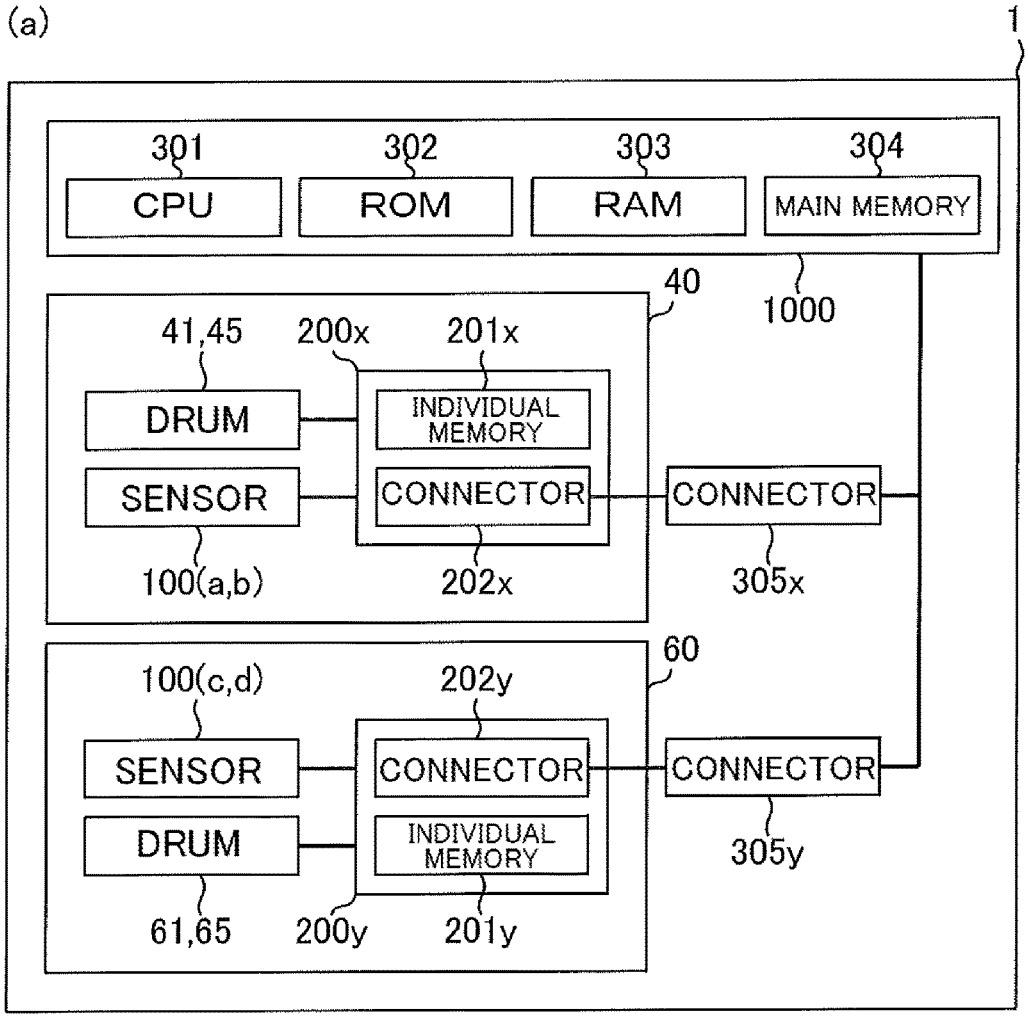
FIGS. 5(*a*) and (*b*) are functional block diagrams of the banknote processing device.
Figure 5B:
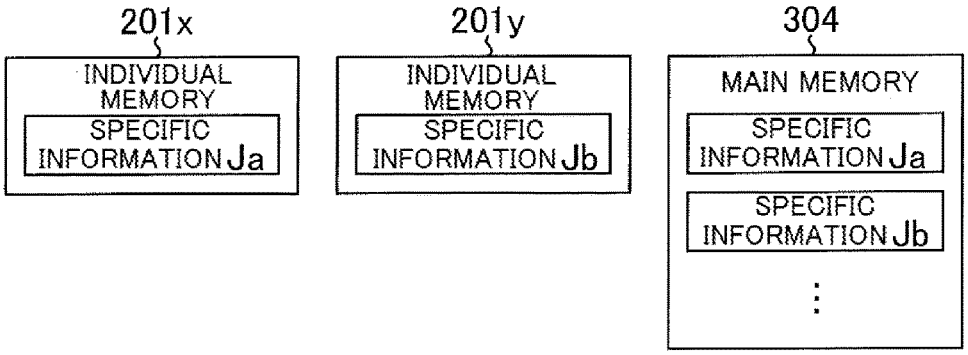

FIG. 5(*a*) is a functional block diagram of the banknote processing device 1 according to the present embodiment. As described above, the banknote processing device 1 is configured to include the control unit 1000 and the banknote storage units (40, 60). Further, the banknote processing device 1 is configured to include the connector 305(*x, y*) as illustrated in FIG. 5(*a*).

As illustrated in FIG. 5(*a*), each of the banknote storage units is configured to include the memory board 200(*x, y*), the drums (41, 45, 61, 65), and the tape full empty sensors 100(*a* to *d*). As described above, the memory board 200 is provided with the individual memory 201(*x, y*) and the connector 202 (*x, y*).

In a case where the first banknote storage unit 40 is attached to the banknote processing device 1, the connector 202*x* of the first banknote storage unit 40 is connected to the connector 305*x* described above. In this case, the control unit 1000 and the first banknote storage unit 40 (the memory board 200*x*) are electrically connected to each other. Further, in a case where the second banknote storage unit 60 is attached to the banknote processing device 1, the connector 202*y* of the second banknote storage unit 60 is connected to the connector 305*y*. In this case, the control unit 1000 and the second banknote storage unit 60 are electrically connected to each other.

The individual memory 201*x* of the first banknote storage unit 40 memorizes therein specific information Ja (see FIG. 6 described below). Although the details thereof are described later, the specific information Ja is updated according to storage or feeding of the banknote in the first banknote storage unit 40. For example, in a case where a maintenance period of the first banknote storage unit 40 is to be decided, the manager refers to the specific information Ja. Further, the individual memory 201*y* of the second banknote storage unit 60 memorizes therein specific information Jb. The specific information Jb is updated according to storage or feeding of the banknote in the second banknote storage unit 60. For example, in a case where a maintenance period of the second banknote storage unit 60 is to be decided, the manager refers to the specific information Jb.

The control unit 1000 is configured to include a CPU 301, a ROM 302, a RAM 303, and a main memory 304. The ROM 302 memorizes therein various pieces of information in a non-volatile manner. For example, the ROM 302 memorizes therein various pieces of information including programs. The CPU 301 executes the programs memorized in the ROM 302. The RAM 303 can memorize therein various pieces of information temporarily. For example, the RAM 303 memorizes therein various pieces of information generated when the CPU 301 executes the programs. Since the CPU 301 executes the program, the deposit operation, the dispense operation, the reject operation, and the collection operation described above are performed.

Specifically, when the CPU 301 of the control unit 1000 performs the deposit operation, the dispense operation, the reject operation, or the collection operation, the control unit 1000 outputs drive signals for driving the respective drums (41, 45, 61, 65) to each of the banknote storage units. The drive signals include information capable of identifying a type of the drum to be driven and a rotation direction. The respective drums of the banknote storage unit are driven (rotated) in a period during which the drive signal is being input. Further, the control unit 1000 stops the output of the drive signal at a predetermined moment. When the input of the drive signal is stopped, the drive of each drum in the banknote storage unit is stopped. The main memory 304 memorizes therein various pieces of information in a non-volatile manner.

FIG. 5(*b*) is an explanatory diagram of information to be memorized in the individual memories 201(*x, y*) of the banknote storage units and the main memory 304 of the control unit 1000. The main memory 304 memorizes therein various pieces of information to be memorized in the individual memories 201 of the banknote storage units. Specifically, the main memory 304 memorizes therein both the specific information Ja to be memorized in the individual memory 201*x* of the first banknote storage unit 40 and the specific information Jb to be memorized in the individual memory 201*y* of the second banknote storage unit 60.

As the main memory 304, for example, a flash memory is preferably adopted. Although a flash memory is exemplified as the main memory 304, another type of memory unit may be adopted as the main memory 304. For example, an EEPROM may be adopted as the main memory 304.

FIG. 6(*a*) is an explanatory diagram of the specific information Ja to be memorized in the individual memory 201*x* of the first banknote storage unit 40. FIG. 6(*a*) illustrates names of respective pieces of information and specific contents included in the specific information Ja.

As illustrated in FIG. 6(*a*), the specific information Ja includes model information, unit ID, software version, set denomination, maximum number of sheets, number of sheets held, motor speed, number of drives, number of rejects, standard light quantity, measured light quantity, and error information. Further, among the pieces of information described above, the set denomination, the maximum number of sheets, the number of sheets held, the motor speed, and the number of drives are provided for each drum (41, 45) of the first banknote storage unit 40.

The model information in the specific information Ja indicates a model name of the banknote processing device 1 to which the first banknote storage unit 40 is connected. Further, the unit ID indicates a numerical value specific to the banknote storage unit. The software version indicates a version of the program of the control unit 1000 of the banknote processing device 1. The set denomination in the specific information Ja is information capable of identifying a denomination to be stored in the drum 41 and a denomination to be stored in the drum 45. In the present embodiment, a case in which a denomination A is stored on the drum 41, and a denomination B is stored on the drum 45 is assumed.

The maximum number of sheets in the specific information Ja indicates the maximum number of banknotes that can be stored on the drum 41 and the maximum number of banknotes that can be stored on the drum 45. In the present embodiment, banknotes of up to 30 sheets can be stored on the drum 41, and banknotes of up to 30 sheets can be stored on the drum 45. The number of sheets held indicates the number of banknotes (a current value) being stored on the drum 41 and the number of banknotes being stored on the drum 45. The manager can ascertain the number of banknotes that can be replenished in the drum based on the maximum number of sheets and the number of sheets stored thereon.

The motor speed indicates the rotation speed of the motor that drives the drum 41 and the rotation speed of the motor that drives the drum 45. Specifically, the motor speed indicates a length of time required for rotating once the motor that drives the drum. For example, when the motor speed in the specific information Ja becomes slower than the standard motor speed, it can be ascertained that maintenance (a replacement work) of the motor is required. The number of drives indicates the number of rotations of the drum 41 and the number of rotations of the drum 45. For example, when the number of drives in the specific information Ja has reached the standard number of rotations, it can be ascertained that the maintenance of the motor is required. The number of rejects indicates the number of times of performing the reject operation described above.

A case in which a banknote is stored in the banknote storage unit by the deposit operation is assumed. In this case, since a new banknote is stored on the drum in the banknote storage unit, the number of sheets held is incremented by the number of sheets newly stored. Further, in this case, since the drum in the banknote storage unit is driven, the number of drives is incremented accordingly. That is, when the banknote is stored in the banknote storage unit by the deposit operation, both the number of sheets held and the number of drives in the specific information J are incremented accordingly. Further, a case in which the reject operation is performed is assumed. In this case, the number of rejects described above is incremented accordingly. Further, when the reject operation is performed and the drum in the banknote storage unit is driven, the number of drives of the drum is also incremented accordingly.

The standard light quantity includes the standard light quantity of the tape full empty sensor 100*a* and the standard light quantity of the tape full empty sensor 100*b*. As described above, the tape full empty sensor 100 is configured by the light emitting element and the light receiving element facing each other via the tape. For example, when a winding position of the tape is at a specific position, light from the light emitting element of the tape full empty sensor 100 is detected by the light receiving element. On the other hand, when the winding position of the tape is at other positions, the light from the light emitting element of the tape full empty sensor 100 is not detected by the light receiving element. In the following descriptions, for explanation purposes, a state where the light from the light emitting element is detected by the light receiving element is referred to as "ON state". Further, a state where the light from the light emitting element is not detected by the light receiving element is referred to as "OFF state".

The standard light quantity of the tape full empty sensor 100 indicates a light quantity detected by the light receiving element when the sensor 100 is in the ON state, at the point of manufacture of the banknote processing device 1 (banknote storage unit). Specifically, the tape full empty sensor 100 generates an electric current of a magnitude according to the light quantity detected by the light receiving element. The magnitude of the electric current at the point of manufacture of the banknote processing device 1 is memorized as the standard light quantity.

The measured light quantity includes the measured light quantity of the tape full empty sensor 100*a* and the measured light quantity of the tape full empty sensor 100*b*. The measured light quantity of the tape full empty sensor 100 indicates a current value of the light quantity detected by the light receiving element, when the tape full empty sensor 100 is in the ON state. That is, the standard light quantity described above can also be referred to as an initial value of the measured light quantity. For example, the control unit 1000 memorizes therein the magnitude of the electric current generated by the light receiving element of the tape full empty sensor 100 as the measured light quantity, at a specific moment.

The specific moment to memorize the measured light quantity can be appropriately set. However, in a case where the tape full empty sensor 100 is in the OFF state, the light receiving element does not receive light. Therefore, the specific moment to memorize the measured light quantity needs to be in a period in which the tape full empty sensor 100 is in the ON state. For example, such a configuration is preferable that the measured light quantity is measured when it is detected that the motor (41, 45) that winds the tape on the drum is stopped, and the tape full empty sensor 100 is in the ON state.

The light quantity detected by the light receiving element of the tape full empty sensor 100 decreases with time. For example, when the light emitting element becomes deteriorated with time, the light quantity from the light emitting element decreases and the light quantity detected by the light receiving element decreases. Further, when soil is accumulated in the light emitting element or the light receiving element, the light quantity detected by the light receiving element decreases. In this case, the maintenance of the tape full empty sensor 100 is required.

In the present embodiment, the standard light quantity and the measured light quantity are memorized as the specific information J. Therefore, by comparing the standard light quantity with the measured light quantity, a decreased amount of the light quantity detected by the light receiving element can be ascertained. According to the configuration described above, for example, when the decreased amount of the light quantity has reached a predetermined threshold, it can be judged that the maintenance of the tape full empty sensor 100 is required.

Error information in the specific information Ja indicates the number of errors detected in the first banknote storage unit 40. As described above, the first banknote storage unit 40 is provided with sensors 101(*a*-*c*) that detect banknotes passing the transport route. In a case where the sensors 101 do not change from the OFF state over a preset time length, there is a high possibility that a banknote jam has occurred in the transport route. For example, when the sensors 101 in the first banknote storage unit 40 are in the OFF state over the preset time length, the control unit 1000 judges that an error of paper jam has occurred inside the first banknote storage unit 40. When it is judged that an error has occurred, the number of errors being the error information is incremented.

The configuration of the banknote storage unit may be such that a plurality of errors including errors other than the banknote jam can be detected in the banknote storage unit. Further, the configuration may be such that a plurality of pieces of error information corresponding to each of the errors are memorized therein. In the configuration, the number of errors being the error information corresponding to the type of error that has occurred is incremented. Therefore, the number of occurrences can be ascertained for each type of the errors.

FIG. 6(*b*) is an explanatory diagram of the specific information Jb memorized in the individual memory 201*y* of the second banknote storage unit 60. FIG. 6(*b*) indicates names of respective pieces of information and specific contents included in the specific information Jb. As described above, the set denomination in the specific information Ja to be memorized in the individual memory 201*x* of the first banknote storage unit 40 indicates the denomination to be stored on the drum 41 and the drum 45 in the first banknote storage unit 40. Meanwhile, the set denomination in the specific information Jb to be memorized in the individual memory 201*y* of the second banknote storage unit 60 indicates the denomination to be stored on the drum 61 and the drum 65 in the second banknote storage unit 60.

The maximum number of sheets in the specific information Jb to be memorized in the individual memory 201*y* of the second banknote storage unit 60 indicates the maximum number of sheets that can be stored on the drum 61 and the drum 65. The number of sheets held in the specific information Jb indicates the number of banknotes being stored on the drum 61 and the drum 65. The motor speed in the specific information Jb indicates the rotation speed of the motor that drives the drum 61 and the motor that drives the drum 65. Similarly, the number of drives in the specific information Jb indicates the number of rotations of the drum 61 and the drum 65.

The standard light quantity in the specific information Jb to be memorized in the individual memory 201*y* of the second banknote storage unit 60 indicates the light quantity detected by the light receiving element of the tape full empty sensor 100*c* and the light receiving element of the tape full empty sensor 100*d* at the time of shipment of the banknote processing device 1. Further, the measured light quantity in the specific information Jb indicates a current value of the light quantity detected by the light receiving element of the tape full empty sensor 100*c* and the light receiving element of the tape full empty sensor 100*d*. The measured light quantity in the specific information Jb is measured at the same moment as that of the measured light quantity in the specific information Ja described above. The error information in the specific information Jb indicates the number of errors occurred in the second banknote storage unit 60.

Among the respective drums (41, 45, 61, 65) of the banknote storage units, there may be a drum, whose number of drives tends to be less than that of other drums, according to the denomination stored on the drum. Further, there may be a drum, whose number of drives tends to be larger than that of other drums, according to the denomination stored on the drum. That is, the period reaching the number of drives, at which the maintenance is required, tends to be different from each other according to the drum. For example, in the example illustrated in FIG. 6, the drum 45 in the first banknote storage unit 40 tends to reach the period in which the maintenance is required earlier than the drum 65 in the second banknote storage unit 60.

Taking the above circumstances into consideration, in the present embodiment, information (the motor speed, the number of drives) for judging the necessity of the maintenance of each drum in the second banknote storage unit 60 is memorized separately for each drum. According to the above configuration, the necessity of the maintenance can be judged for each drum, and the maintenance can be performed only to the drum that requires the maintenance. According to the above configuration, for example, there is an advantage that the maintenance with respect to the drum that does not require the maintenance can be omitted and the working time required for the maintenance can be reduced, as compared to the configuration in which the necessity of the maintenance cannot be ascertained for each drum. Further, there is an advantage that the cost required for the maintenance can be reduced.

Figure 7:
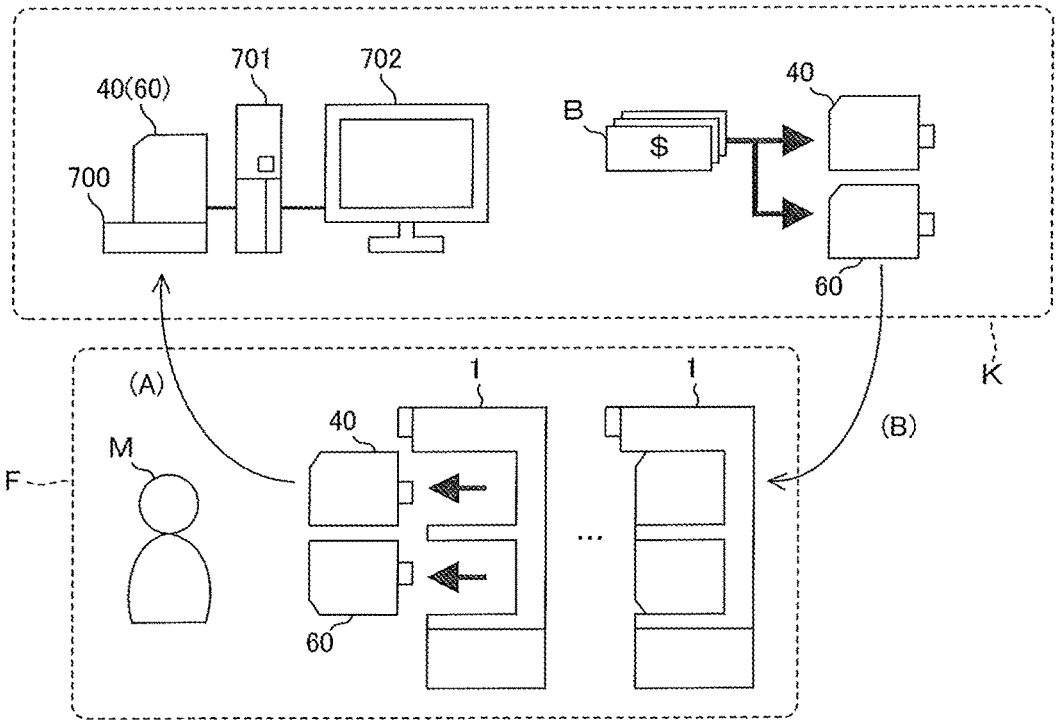
FIG. 7 is an explanatory diagram of a specific example of a maintenance method of the banknote processing device.
Figure 8A:
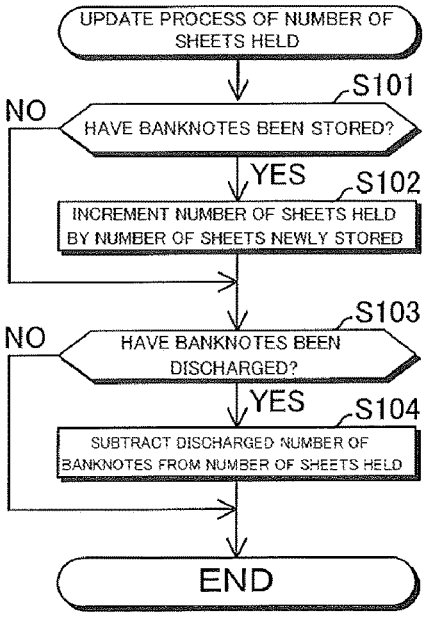
FIG. 8(*a*) to FIG. 8(*f*) are flowcharts of processes for updating specific information.
Figure 8B:
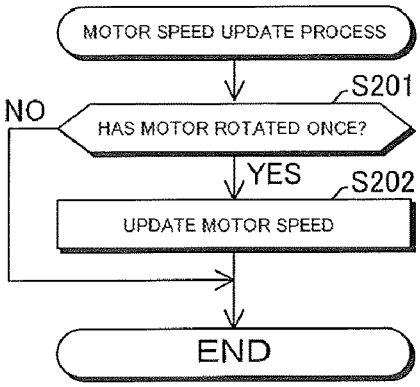
Figure 8C:
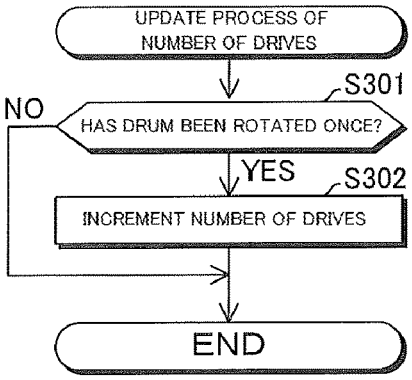
Figure 8D:
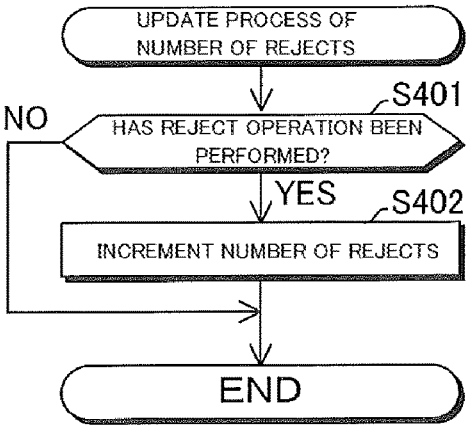
Figure 8E:
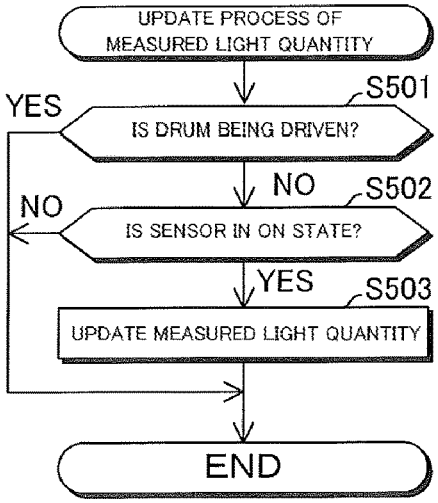
Figure 8F:
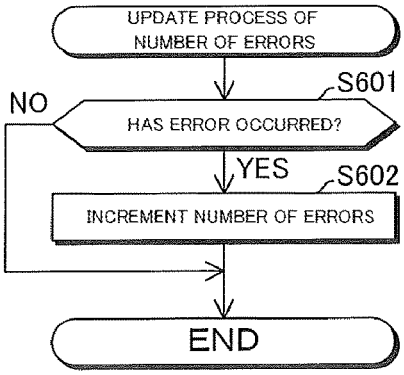

FIG. 7 is an explanatory diagram of a specific example of a maintenance method of the banknote processing device 1 (the banknote storage units 40 and 60). As illustrated in FIG. 7, in the specific example, a plurality of banknote processing devices 1 are arranged on a floor F of a casino. The banknote processing devices 1 are used for exchange, for example, by players of a casino machine.

As illustrated in FIG. 7, an information reader 700, an administrative computer 701, and an administrative monitor 702 are installed in a management room K. A manager M of the banknote processing device 1 can enter the management room K, and players cannot enter the management room K basically. The manager M performs the maintenance of the banknote storage units (drums, sensors) of the banknote processing device 1. Further, the manager M replenishes banknotes to the banknote storage units. As described above, the banknote storage units (40, 60) of the banknote processing device 1 are detachably provided. When performing the maintenance of the banknote storage units or replenishment of banknotes, the manager M detaches the banknote storage unit from the banknote processing device 1 and moves the banknote storage unit from the floor F to the management room K (an arrow (A) in FIG. 7).

The information reader 700 according to the present embodiment can be connected to the banknote storage unit detached from the banknote processing device 1. Specifically, the information reader 700 includes a connector into which the connectors 202(*x, y*) of the banknote storage units can be inserted. When the connector 202 of the banknote storage unit is inserted into the connector of the information reader 700, the memory board 200 (the individual memory 201) of the banknote storage unit and the information reader 700 are electrically connected with each other. In this case, the pieces of specific information J(a, b) in the individual memory 201 of the banknote storage unit are read by the information reader 700.

The specific information J read from the information reader 700 is input to the administrative computer 701. When the specific information J is input to the administrative computer 701, the administrative computer 701 causes an image representing the specific information J to be displayed on the administrative monitor 702. The manager M confirms the specific information J displayed on the administrative monitor 702 to judge the necessity of the maintenance.

For example, when the number of drives of the drum in the banknote storage unit (see FIG. 6 described above) exceeds a predetermined threshold, the drum is replaced by a new drum. In this case, the configuration may be such that the number of drives of the drum can be initialized. For example, such a configuration can be considered that respective pieces of information in the specific information J of the banknote storage unit connected to the information reader 700 can be changed by operating an operating unit (a keyboard or the like) connected to the administrative computer 701. In this configuration, in the case of replacing the drum by a new drum, the number of drives can be changed to a numerical value "0".

In a case where banknotes are replenished in the banknote storage unit, the operating unit of the administrative computer 701 is appropriately operated to change the number of sheets held in the specific information J of the banknote storage unit. For example, such a case is assumed that the number of sheets held in the specific information J memorized in the individual memory 201 is N (N is a positive integer) before replenishment of banknotes to the banknote storage unit. In this case, in a case where M banknotes (M is a positive integer) are to be replenished in the banknote storage unit, the number of sheets held in the specific information J is changed to N+M. As illustrated in FIG. 7, after the banknotes are replenished in the banknote storage unit, the banknote storage unit is moved to the floor F (an arrow (B) in FIG. 7).

Such a configuration is assumed that the banknote storage unit cannot be detached from the banknote processing device 1 (hereinafter, "comparative example"). In the comparative example, the manager M needs to perform a replenishment operation of banknotes on the floor F where the banknote processing device 1 is arranged. However, persons other than the manager M (for example, players) pass by on the floor F. Therefore, there is a problem in crime prevention in the comparative example in which the replenishment operation of banknotes needs to be performed on the floor F.

Taking the above circumstances into consideration, in the present embodiment, the banknote storage unit can be detached from the banknote processing device 1. According to such a configuration, since the replenishment operation of banknotes can be performed in the management room K, the security problem described above is solved. Further, in the above configuration, both a judgment operation of the necessity of the maintenance of the banknote storage unit and the maintenance thereof can be performed in the management room. Therefore, there is an advantage that immediately after judging the necessity of the maintenance of the banknote storage unit, the maintenance of the banknote storage unit can be started.

FIG. 8(*a*) to FIG. 8(*f*) are flowcharts of various processes (an update process of the number of sheets held and the like) to be performed by the CPU 301 of the control unit 1000. The respective pieces of the specific information J (the number of sheets held and the like) are updated by the respective processes.

FIG. 8(*a*) is a flowchart of the update process of the number of sheets held. The update process of the number of sheets held is a process for updating the number of sheets held in the specific information J (see FIG. 6). When starting the update process of the number of sheets held, the CPU 301 determines whether banknotes have been newly stored on the respective drums (S101). Upon determination that banknotes have not been newly stored on the respective drums (NO at Step S101), the CPU 301 forwards the process to Step S103 described later. On the other hand, upon determination that the banknotes have been newly stored on the respective drums (YES at Step S101), the CPU 301 increments the number of sheets held on the drum on which the banknotes have been newly stored (S102), and forwards the process to Step S103. At Step S103, the CPU 103 determines whether a banknote has been discharged from each drum. Upon determination that a banknote has not been discharged from each drum (NO at Step S103), the CPU 301 ends the update process of the number of sheets held. On the other hand, upon determination that banknotes have been discharged from each drum (YES at Step S103), the CPU 301 subtracts the discharged number of banknotes from the number of sheets held on the drum, from which the banknotes have been discharged (S104), to end the update process of the number of sheets held.

FIG. 8(*b*) is a flowchart of a motor speed update process. The motor speed update process is a process for updating the motor speed in the specific information J. When starting the motor speed update process, the CPU 301 determines whether any of the motors that drive the respective drums has rotated once (S201). Upon determination that any of the motors has not rotated once (NO at Step S201), the CPU 301 ends the motor speed update process. On the other hand, upon determination that any of the motors has rotated once (YES at Step S201), the CPU 301 updates the motor speed of the motor (S202). Specifically, the CPU 301 memorizes therein a time length required this time until the motor rotates once as the latest motor speed. After updating the motor speed, the CPU 301 ends the motor speed update process.

FIG. 8(*c*) is a flowchart of an update process of the number of drives. The update process of the number of drives is a process for updating the number of drives in the specific information J. When starting the update process of the number of drives, the CPU 301 determines whether any of the drums has been rotated once (S301). Upon determination that any of the drums has not been rotated once (NO at Step S301), the CPU 301 ends the update process of the number of drives. On the other hand, upon determination that any of the drums has been rotated once (YES at Step S301), the CPU 301 increments the number of drives of the drum (S302). After incrementing the number of drives, the CPU 301 ends the update process of the number of drives.

FIG. 8(*d*) is a flowchart of an update process of the number of rejects. The update process of the number of rejects is a process for updating the number of rejects in the specific information J. When starting the update process of the number of rejects, the CPU 301 determines whether a reject operation has been performed (S401). Upon determination that the reject operation has not been performed (NO at Step S401), the CPU 301 ends the update process of the number of rejects. On the other hand, upon determination that the reject operation has been performed (YES at Step S401), the CPU 301 increments the number of rejects (S402). After incrementing the number of rejects, the CPU 301 ends the update process of the number of rejects.

FIG. 8(*e*) is a flowchart of an update process of the measured light quantity. The update process of the measured light quantity is a process for updating the measured light quantity in the specific information J. In the update process of the measured light quantity, the CPU 301 determines whether the respective drums are being driven (S501). Upon determination that the respective drums are being driven (YES at S501), the CPU 301 ends the update process of the measured light quantity. On the other hand, upon determination that the respective drums are not being driven (NO at S501), the CPU 301 determines whether the tape full empty sensor 100 is in the ON state (S502). Upon determination that the tape full empty sensor 100 is not in the ON state (NO at S502), the CPU 301 ends the update process of the measured light quantity. On the other hand, upon determination that the tape full empty sensor 100 is in the ON state (YES at S502), the CPU 301 memorizes therein the current value of the light quantity detected by the light receiving element of the tape full empty sensor 100 as the measured light quantity (S503), and ends the update process of the measured light quantity.

FIG. 8(*f*) is a flowchart of an update process of the number of errors. The update process of the number of errors is a process for updating the number of errors in the specific information J. When starting the update process of the number of errors, the CPU 301 determines whether an error has occurred (S601). Upon determination that no error has occurred (NO at S601), the CPU 301 ends the update process of the number of errors. On the other hand, upon determination that an error has occurred (YES at S601), the CPU 301 increments the number of errors by the number of errors occurred (S602). After incrementing the number of errors, the CPU 301 ends the update process of the number of errors.

Second Embodiment

Another embodiment of the present invention is described below. In the respective modes exemplified below, constituent elements whose operations or functions are identical to those of the first embodiment are denoted by like reference signs referred to in the descriptions of the first embodiment and descriptions thereof are omitted as appropriate.

Figure 9:
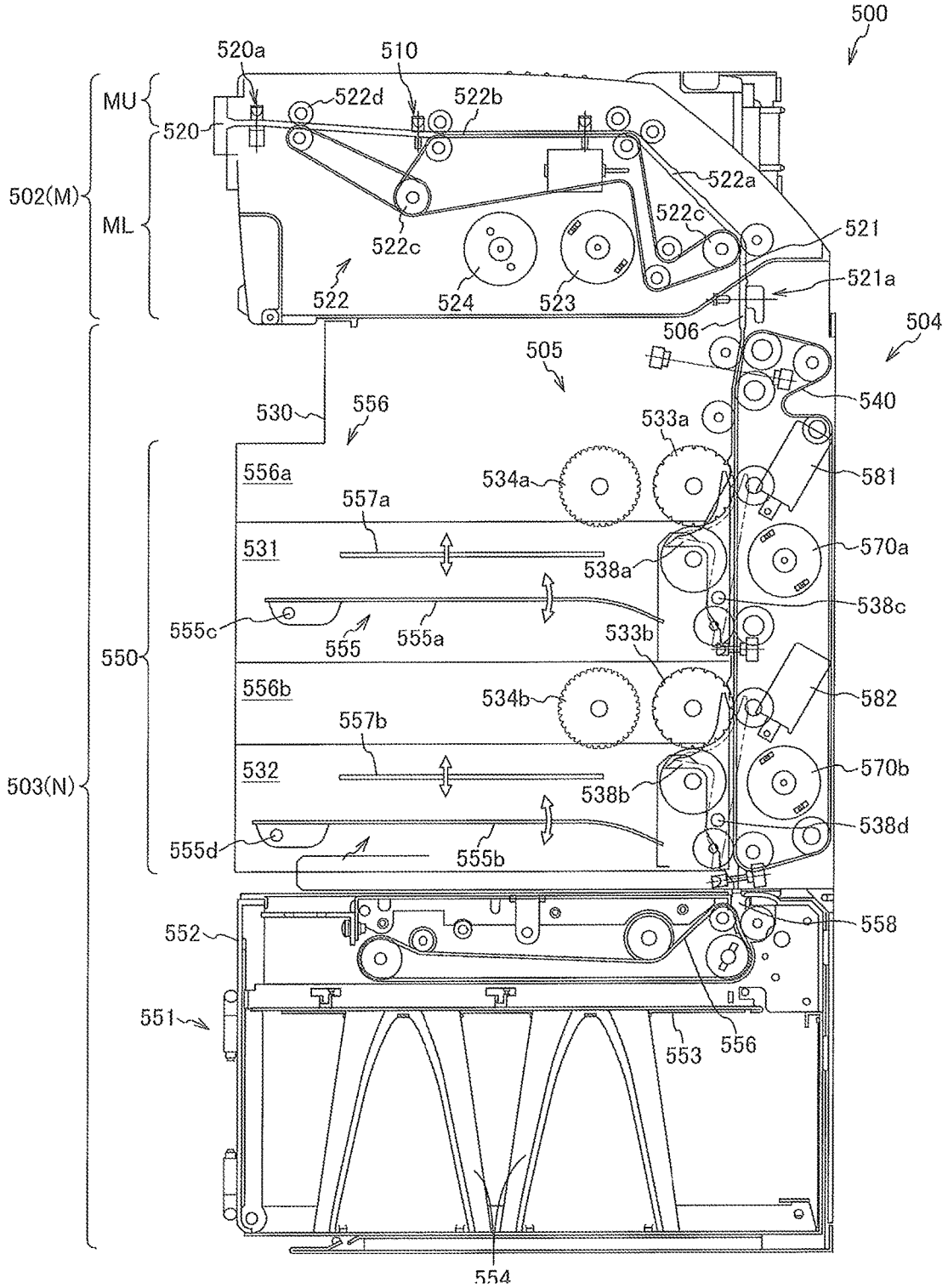
FIG. 9 is an explanatory diagram of a banknote processing device according to a second embodiment.

FIG. 9 is an explanatory diagram of another configuration example of the banknote processing device including the banknote storage unit according to the present invention. FIG. 9 is a sectional view of a banknote processing device 500 cut vertically as seen from the front.

The banknote processing device 500 includes a deposit and withdrawal processing unit 502(M (MU, ML)), a banknote storage unit 503(N) detachably attached to a frame 502*a* of the deposit and withdrawal processing unit, and a main transport device 504 fixed to the frame 502*a* to transport banknotes between the deposit and withdrawal processing unit 502 and the banknote storage unit 503.

The deposit and withdrawal processing unit 502 includes an inlet/outlet 520 that inputs or outputs banknotes as the paper sheets to and from the deposit and withdrawal processing unit 502, an outlet 521 for discharging banknotes from the deposit and withdrawal processing unit 502, an authentication transport path (deposited banknote transport route) 522*a* for transporting banknotes between the inlet/outlet 520 and the outlet 521, and an authentication transport device 522 that transports banknotes along the authentication transport path 522*a*. The deposit and withdrawal processing unit 502 also includes a stack motor 524 that drives a gear train provided in a collection box 551 via a gear train (not illustrated) provided in the deposit and withdrawal processing unit 502, an inlet sensor 520*a* that detects an inserted or dispensed banknote, and an outlet sensor 521*a* that detects a banknote discharged from the deposit and withdrawal processing unit 502. The authentication transport device 522 includes a transport motor 523, a transport belt 522*b* rotated by the transport motor 523 to transport banknotes along the authentication transport path 522*a*, a plurality of pulleys 522*c* around which the transport belt 522*b* is wound, and a plurality of idle rollers 522*d* that come in contact with the transport belt 522*b* to transport banknotes. Further, the transport motor 523 drives a main transport belt 540 via a gear train (not illustrated) to move banknotes along a circulation transport path 506 in the main transport device 504. An authentication sensor 510 that detects optical characteristics or magnetic characteristics of banknotes is provided along the authentication transport path 522*a*.

The outlet 521 of the deposit and withdrawal processing unit 502 is connected to the authentication transport path 522*a* formed in the deposit and withdrawal processing unit 502 and the circulation transport path 506 formed in the main transport device 504.

The banknote storage unit 503 includes a first circulation-type banknote storage unit 531, a second circulation-type banknote storage unit 532, and the collection box 551 arranged below thereof. The collection box 551 stores banknotes of denominations that are not stored in the respective banknote storage units 531 and 532 so as not to be able to discharge banknotes.

In the embodiment of the present invention, a single or a plurality of circulation transport devices 505 that store banknotes supplied from the inlet/outlet 520 through the deposit and withdrawal processing unit 502, and discharges banknotes stored therein through the deposit and withdrawal processing unit 502 to the inlet/outlet 520, and a circulation box 550 that stores banknotes so as to be able to discharge banknotes are provided in the banknote storage unit 503. A circulation motor 570 separably and drivably connected to the circulation transport device 505 is provided in the main transport device 504. In this case, by rotating the circulation motor 570 in one direction to drive the circulation transport device 505, banknotes supplied from the deposit and withdrawal processing unit 502 are stored in the banknote storage unit 503. Further, by rotating the circulation motor 570 in the other direction to drive the circulation transport device 505 in a reverse direction, banknotes stored in the banknote storage unit 503 are discharged to the inlet/outlet 520.

When the banknote storage unit 503 is attached to the deposit and withdrawal processing unit 502, the circulation transport device 505 is drivably connected to the circulation motor 570 automatically, so that the circulation transport device 505 can be activated in conjunction with the operation of the main transport device 504 or activated systematically and methodically.

The circulation box 550 includes a casing 530 detachably attached into the deposit and withdrawal processing unit 502 to form the banknote storage unit 503, a first banknote storage unit having a first circulation-type banknote storage unit 531 formed on an upper stage in the casing 530, and a second banknote storage unit having a second circulation-type banknote storage unit 532 arranged below the first circulation-type banknote storage unit 531. The first circulation-type banknote storage unit 531 stores therein banknotes of a specific denomination so as to be able to discharge the banknotes, and the second circulation-type banknote storage unit 532 is arranged below the first circulation-type banknote storage unit 531 to store banknotes of another denomination so as to be able to discharge the banknotes.

The first circulation-type banknote storage unit 531 and the second circulation-type banknote storage unit 532 each include a supply roller 533*a*, 533*b* for taking in banknotes from the circulation transport path 506, a feeding roller 534*a*, 534*b* for dispensing banknotes from each of the banknote storage units 531 and 532 to the circulation transport path 506, a support plate 557*a*, 557*b* that is moved up and down by a lifter (not illustrated), a bottom plate 555*a*, 555*b* arranged below each support plate to support banknotes transferred from each support plate, and a pressing member (not illustrated) fixedly arranged above each support plate to press a banknote into the storage space (onto the bottom plate) by coming in contact with the banknote on the support plate when each support plate moves upward. The bottom plate 555*a*, 555*b* is supported with a right end being able to be turned vertically by a shaft 555*c*, 555*d* each provided at a left end thereof. The support plates 557*a* and 557*b* each have an opening for inserting a banknote at a central part in a depth direction (in a width direction) in the drawing. When each support plate is lifted, the pressing member relatively moves downward from an upper side of respective support plates via the opening, thereby transferring the banknote on each support plate onto each bottom plate through the opening.

The supply roller 533*a*, 533*b* provided in each of the banknote storage units 531 and 532 rotates in forward and reverse directions in a supply direction and a feeding direction in a state of being in contact with the transport belt 540 as illustrated in FIG. 9, and transports a banknote by putting the banknote between the transport belt and the supply roller. The supply rollers 533*a* and 533*b* and the feeding rollers 534*a* and 534*b* are each driven by a corresponding circulation motor 570*a*, 570*b*.

The banknote storage unit 503 includes an upper deflection lever 538*a* and a lower deflection lever 538*b* that each guide banknotes supplied from the deposit and withdrawal processing unit 502 to the first circulation-type banknote storage unit 531 and the second circulation-type banknote storage unit 532 and are movable between an opening position (an upper end is on the right) at which the banknotes each discharged from the respective banknote storage units 531 and 532 are guided toward the deposit and withdrawal processing unit 502 and a closing position (the upper end is on the left) to block the guide. The upper deflection lever 538*a* and the lower deflection lever 538*b* turn between the opening position projecting into the circulation transport path 506 and the closing position separated from the circulation transport path 506, about each shaft 538*c*, 538*d* by a drive force of each solenoid 251, 252. When the upper deflection lever 538*a* and the lower deflection lever 538*b* are at the opening position, an upper end projects into the circulation transport path 506, to block storage of banknotes in the other circulation box, discharge of banknotes from the other circulation box, and transport of banknotes to the collection box 551. When the upper deflection lever 538*a* and the lower deflection lever 538*b* are at the closing position, the upper end does not project into the circulation transport path 506, and thus does not block storage of banknotes in the other circulation box, discharge of banknotes from the other circulation box, and transport of banknotes to the collection box 551.

Banknotes inserted into the inlet/outlet 520 and supplied from the deposit and withdrawal processing unit 502 to the circulation transport path 506 are sorted into the storage unit 531 or 532 corresponding to the denomination thereof and stored therein. At this time, the deflection levers 538*a* and 538*b* corresponding to the storage unit that stores the banknote are each at the opening position. When it is detected that ends of banknotes enter into the corresponding storage unit, the banknotes are guided onto the support plate 557*a*, 557*b* in a standby state illustrated in FIG. 9, by driving the supply rollers 533*a* and 533*b* for taking in the banknote from the circulation transport path 506 in a taking-in direction. By lifting the support plate toward the pressing member (not illustrated) in a fixed state in a state where the banknote moves onto the support plate and is stopped, a central portion in the width direction of the banknote is pressed by the pressing member and the banknote is transferred onto the bottom plate 555*a*, 555*b* through the opening provided in the central portion of the support plate. That is, since the pressing member presses the banknote on the support plate biased by a spring in a lifting direction against a spring force, transfer of the banknote onto the bottom plate is complete. Further, banknotes (in a bundle) after transferred onto each bottom plate are maintained in an aligned state by the upper surface thereof being pressed by a lower surface of each support plate.

In a dispense operation of banknotes from the respective circulation-type banknote storage units 531 and 532, the bottom plates 555*a* and 555*b* are each turned in the lifting direction about the shaft 555*c*, 555*d* by the lifter and maintained in an inclined state, thereby causing the upper surface of the banknote bundle on the respective bottom plates 555*a* and 555*b* to abut on the feeding rollers 534*a* and 534*b*, to complete preparation for dispensing banknotes. Further, by rotating the feeding rollers 534*a* and 534*b* and the supply rollers 533*a* and 533*b* in the feeding direction, the banknotes can be fed out from the respective circulation-type banknote storage units 531 and 532 to the circulation transport path 506.

Next, in a state where the respective deflection levers 538*a* and 538*b* are turned to the opening position by respective solenoids 581 and 582, when the circulation motor 570*a*, 570*b* corresponding to the denomination is rotated in a reverse direction, the transfer motor 523 is rotated in the reverse direction, and the banknote of a predetermined denomination is discharged from the corresponding circulation-type banknote storage unit.

The configuration of the collection box 551 according to the present example is configured in the same manner as that of the collection box 80 in FIG. 1.

That is, the collection box (collected-banknote storage unit) 551 includes a banknote loading table 553 supported so as to be able to move up and down in the casing 552, on an upper surface of which banknotes are loaded, a spring 554 that biases the banknote loading table upward all the time, a transfer belt 556 that transfers a banknote transported from the inlet/outlet 520 onto the banknote loading table, while a lower-side traveling surface thereof is coming in contact with an upper surface of the banknote loading table 553 (an already loaded banknote), a lifting arm (not illustrated) that presses the banknote transferred onto the banknote loading table by the lower surface of the transfer belt onto the banknote loading table, and the like.

The deposit and withdrawal processing unit 502 according to the second embodiment includes the control unit 1000 as in the deposit and withdrawal processing unit M of the first embodiment. The control unit 1000 performs, for example, a process to drive the respective motors in the banknote processing device 500. Further, in the casing 530 (the first circulation-type banknote storage unit 531 and the second circulation-type banknote storage unit 532) of the second embodiment, a memory board having a connector (corresponding to the connector 202 of the first embodiment in FIG. 5) is provided.

The deposit and withdrawal processing unit 502 includes a connector (corresponding to the connector 305 of the first embodiment in FIG. 5) capable of being connected to the connector of the memory board in the casing 530. When the casing 530 is attached to the deposit and withdrawal processing unit 502, the connector on the side of the casing 530 is inserted into the connector on the side of the deposit and withdrawal processing unit 502. In this case, the memory board in the casing 530 is electrically connected to the control unit 1000.

An individual memory (corresponding to the individual memory 201 of the first embodiment) is provided in the memory board of the casing 530. The individual memory described above memorizes therein various pieces of information in a non-volatile manner. As the individual memory, for example, a flash memory can be adopted. The various pieces of information to be memorized in the individual memory of the casing 530 include specific information Jx.

FIG. 10 is an explanatory diagram of the specific information Jx to be memorized in the individual memory of the casing 530. In the casing 530, a near-full sensor and an end sensor are provided. The near-full sensor becomes an OFF state when the number of banknotes stored between the bottom plate 555 and the support plate 557 has reached the preset number of banknotes. Specifically, a distance (a thickness of a banknote bundle) between an uppermost banknote of the banknotes stored between the bottom plate 555 and the support plate 557 and the bottom plate 555 becomes longer, as the number of stored banknotes increases. The near-full sensor detects the uppermost banknote of the banknotes, when the number of stored banknotes has reached about 25 sheets.

According to the second embodiment, up to about 30 sheets of banknotes can be stored between the bottom plate 555 and the support plate 557. That is, when the near-full sensor is shifted to the OFF state, up to five banknotes can be stored thereafter. When the near-full sensor is shifted to the OFF state, this matter is notified. For example, such a configuration can be considered that a banknote-full LED is provided in the banknote processing device 500, and when the near-full sensor is shifted to the OFF state, the banknote-full LED is turned on. In this configuration, when the banknote-full LED is turned on, it can be ascertained that the banknotes in the casing 530 need to be collected.

The end sensor in the casing 530 becomes an OFF state when the support plate 557 has moved to a specific position. Specifically, as described above, the support plate 557 is driven to move up. According to the second embodiment, the support plate 557 moves up to a position where the end sensor detects the support plate 557. When having detected the uppermost banknote on the support plate 557, the end sensor is shifted to the OFF state, and a detection signal is transmitted to the control unit 1000. Upon reception of the detection signal, the control unit 1000 outputs a stop signal for stopping the upward movement of the support plate 557 to the casing 530. When the stop signal is input to the casing 530, the upward movement of the support plate 557 stops.

The casing 530 includes the first circulation-type banknote storage unit 531 and the second circulation-type banknote storage unit 532. The near-full sensor and the end sensor are provided in each of the first circulation-type banknote storage unit 531 and the second circulation-type banknote storage unit 532. In the following descriptions, the near-full sensor and the end sensor in the first circulation-type banknote storage unit 531 are referred to as "first near-full sensor" and "first end sensor" for explanation purposes. Further, the near-full sensor and the end sensor in the second circulation-type banknote storage unit 531 are referred to as "second near-full sensor" and "second end sensor".

As illustrated in FIG. 10, the specific information Jx according to the second embodiment includes model information, unit ID, and software version as in the specific information J(a, b) of the first embodiment described above. Further, the specific information Jx includes the set denomination. The set denomination in the specific information Jx according to the second embodiment indicates the denomination to be stored in the first circulation-type banknote storage unit 531 and the denomination to be stored in the second circulation-type banknote storage unit 532. In a specific example illustrated in FIG. 10, such a case is assumed that banknotes of the denomination A are stored in the first circulation-type banknote storage unit 531 and banknotes of the denomination B are stored in the second circulation-type banknote storage unit 532.

The specific information Jx includes the maximum number of sheets and the number of sheets held. The maximum number of sheets includes information indicating the maximum number of banknotes (30 sheets in the example of FIG. 10) that can be stored in the first circulation-type banknote storage unit 531 and the maximum number of banknotes (30 sheets in the example of FIG. 10) that can be stored in the second circulation-type banknote storage unit 532. Further, the number of sheets held includes information indicating the number of banknotes (10 sheets in the example of FIG. 10) to be stored in the first circulation-type banknote storage unit 531 and the number of banknotes (12 sheets in the example of FIG. 10) to be stored in the second circulation-type banknote storage unit 532.

The specific information Jx also includes the standard light quantity and the measured light quantity. The near-full sensor according to the second embodiment is configured to include a light receiving element and a light emitting element as in the sensor 100 of the first embodiment. Further, the end sensor is configured to include a light receiving element and a light emitting element. The standard light quantity in the specific information Jx includes information indicating a light quantity detected by the light receiving element of the first near-full sensor and information indicating a light quantity detected by the light receiving element of the second near-full sensor. Further, the measured light quantity in the specific information Jx includes information indicating a current value of the light quantity detected by the light receiving element of the first near-full sensor and information indicating a current value of the light quantity detected by the light receiving element of the second near-full sensor. The error information in the specific information Jx indicates the number of errors having occurred in the casing 530.

According to the second embodiment described above, effects identical to those of the first embodiment can be exhibited. In the second embodiment, an individual memory that memorizes therein information relating to the first circulation-type banknote storage unit 531 (such as the standard light quantity of the first near-full sensor) and an individual memory that memorizes therein information relating to the second circulation-type banknote storage unit 532 (such as the standard light quantity of the second near-full sensor) can be provided separately. However, in the configuration described above, two or more individual memories are required. According to the second embodiment, since one individual memory is sufficient, there is an advantage that the number of memories can be reduced.

Modification

The respective embodiments described above are modified variously. A specific modification is exemplified below. Two or more of embodiments optionally selected from the following exemplifications can be combined with each other appropriately.

(1) The specific information J in each embodiment described above can be appropriately changed. For example, such a configuration may be used that the standard light quantity and the measured light quantity of each sensor described above are not included in the specific information J. Further, in addition to the error information indicating the number of occurrences of an error, information capable of specifying date and time when an error has occurred may be included in the specific information J. Specifically, an RTC (real time clock) circuit that can generate time information is provided in the control unit. When an error has occurred, the individual memory memorizes therein time information of the RTC circuit as the specific information J. According to the configuration described above, the time at which an error has occurred can be specified ex-post facto.

(2) In the respective embodiments described above, the control unit 1000 can have such a configuration that the measured light quantity is adjusted to the standard light quantity at a specific moment (for example, at the time of power-on). Specifically, the light quantity of the light emitting element of the sensor is adjusted so that the measured light quantity becomes the standard light quantity. Further, in the configuration described above, the configuration may be such that the standard light quantity (the light quantity after the adjustment) can be changed by, for example, appropriately operating the operating unit of the administrative computer 701 in a state where the banknote storage unit is connected to the information reader 700. The manager can improve the detection accuracy of the respective sensors by setting an optimum standard light quantity for each sensor.

(3) In the respective embodiments described above, the configuration may be such that the individual memory is provided in the collection box 80. For example, when a memory board in which the individual memory is installed is provided in the collection box 80 and the collection box 80 is attached to the banknote processing device 1, the memory board and the control unit 1000 are electrically connected to each other. In the individual memory, the specific information J of the collection box 80 is memorized. Further, in the configuration, the number of banknotes to be stored in the collection box 80 is included in the specific information J. Further, the configuration may be such that the number of banknotes stored in the collection box 80 is memorized in the individual memory for each denomination.

(4) In the first embodiment described above, the specific information J can be read from the connector 305 of the banknote storage unit (40, 60). The connector 305 described above is located on a back side of the banknote storage unit (an opposite side to a user), and in a state of being attached to the banknote processing device 1, the connector 305 is stored inside the banknote processing device 1. However, the configuration may be such that the connector is provided on the front side (a user side) of the banknote storage unit, and the specific information J can be read from the connector. However, in this modification, an illegal action to acquire or falsify the specific information J becomes easy by using, for example, an illegal reader. According to the first embodiment, the connector capable of reading the specific information J is provided only on the back side of the banknote storage unit. Therefore, there is an effect of preventing the illegal action described above.

(5) In the first embodiment described above, banknotes of one denomination are stored on one drum (41, 45, 61, 65) of the banknote storage unit (40, 60). However, such a configuration may be used that each of the drums in the banknote storage unit stores banknotes of different denominations. For example, such a case is assumed that banknotes of the denomination "A" and banknotes of the denomination "B" are deposited at a time. In this case, in the configuration in which banknotes of one denomination are stored on one drum in the banknote storage unit (for example, the first embodiment), since banknotes of the denomination "A" and banknotes of the denomination "B" are stored on the separate drums, control for switching the drum on which the banknotes are stored is required. On the other hand, in the modification, since banknotes of the denomination "A" and banknotes of the denomination "B" can be stored on the same drum, the control for switching the drum on which the banknotes are stored is not required. Therefore, according to the modification, there is an advantage that control in a case in which banknotes of a plurality of denominations are deposited at a time can be simplified.

FIG. 11 is an explanatory diagram of sequence information j according to the modification. The sequence information j is memorized in the individual memory 201 of the banknote storage unit and the main memory 304 of the control unit 1000 as the specific information J. The sequence information j(a-d) is provided in each drum (41, 45, 61, 65) of the banknote storage units, and indicates an order of banknotes to be discharged from the drum (hereinafter, "storing order"). As illustrated in FIG. 11, the sequence information j includes sequence information ja, sequence information jb, sequence information jc, and sequence information jd. The sequence information ja indicates the storing order on the drum 41 provided in the banknote storage unit 40. The sequence information jb indicates the storing order on the drum 45 provided in the banknote storage unit 40. The sequence information jc indicates the storing order on the drum 61 provided in the banknote storage unit 60. The sequence information jd indicates the storing order on the drum 65.

In a specific example in FIG. 11, the sequence information ja is memorized at addresses "a00 to a29" in the individual memory 201. Similarly, the sequence information jb is memorized at addresses "b00 to b29" in the individual memory 201, the sequence information jc is memorized at addresses "c00 to c29" in the individual memory 201, and the sequence information jd is memorized at addresses "d00 to d29" in the individual memory 201. At respective addresses in the sequence information j, information indicating a denomination of banknotes stored in a drum corresponding to the sequence information j is memorized. In the specific example in FIG. 11, such a case is assumed that banknotes of the denomination "A", the denomination "B", and a denomination "C" are to be stored on each drum. Characters "Null" in FIG. 11 mean empty data.

In the specific example in FIG. 11, of banknotes stored on (wound around) the drum, the denomination of a banknote stored earlier is memorized at the smallest address in the sequence information j. For example, in the specific example in FIG. 11, such a case is assumed that three banknotes of the denomination "A" and one banknote of the denomination "C", in total, four banknotes are memorized in the drum 41. Further, in the specific example, two banknotes of the denomination "A" are first stored, and thereafter, one banknote of the denomination "C" is stored, and then, one banknote of the denomination "A" is stored. In this case, information indicating the denomination "A" is memorized at the address "a00" in the sequence information ja, information indicating the denomination "A" is memorized at the address "a01", information indicating the denomination "C" is memorized at the address "a02", and information indicating the denomination "A" is memorized at the address "a03".

The sequence information ja described above indicates that the banknotes can be discharged in an order (a storing order) of "denomination A→denomination A→denomination C→denomination A" from the drum 41. Similarly, the sequence information jb illustrated in FIG. 11 indicates that the banknotes can be discharged in an order of "denomination A→denomination C→denomination C→denomination A□denomination B" from the drum 45. The sequence information jc indicates that the banknotes can be discharged in an order of "denomination C→denomination B→denomination A→denomination A→denomination A→denomination B" from the drum 61, and the sequence information jd indicates that the banknotes can be discharged in an order of "denomination B→denomination B→denomination A→denomination C→denomination A→denomination A" from the drum 65.

As described above, the sequence information j is memorized in the individual memory 201 of the banknote storage unit. In the configuration described above, the sequence information j may be read by the information reader 700 and displayed on the administrative monitor 702. According to this configuration, the storing order of banknotes stored in the banknote storage unit can be confirmed on the administrative monitor 702.

The configuration may be such that the sequence information j in the individual memory 201 and the sequence information j in the main memory 304 can be compared with each other at a specific moment. As a specific example of the configuration, for example, such a configuration can be considered that when the banknote storage unit is attached to the banknote processing device 1, the sequence information j in the individual memory 201 and the sequence information j in the main memory 304 are compared with each other. In the above configuration, when the comparison result shows that the pieces of sequence information j do not match each other, this matter may be notified. Further, such a configuration may be used that when the comparison result shows that the pieces of sequence information j do not match each other, the banknote processing device 1 becomes inoperative. Such a configuration may also be used that, when the comparison result shows that the pieces of sequence information j do not match each other, the sequence information j in the individual memory 201 overwrites the sequence information j in the main memory 304.

(6) In the first and second embodiments described above, the configuration may be such that the specific information J in the individual memory 201 of the banknote storage unit is compared with the specific information J in the main memory 304 of the control unit 1000, and when the pieces of specific information J in the both memories do not match each other, specific processing is performed. For example, the configuration may be such that, when a comparison result between the specific information J in the individual memory 201 of the banknote storage unit and the specific information J in the main memory 304 of the control unit 1000 indicates that there is a difference between these pieces of specific information J, a process for notifying this matter is performed. Further, the configuration may be such that the comparison result is memorized in the individual memory 201, and when the specific information J is read by the information reader 700, the comparison result is displayed on the administrative monitor 702. In this case, the manager can ascertain that a banknote storage unit different from the banknote storage unit to be attached originally is attached to the banknote processing device 1.

(7) In the respective embodiments described above, by displaying the specific information J on the administrative monitor 702, the timing to perform maintenance with respect to the respective configurations (the drum and the like) of the banknote storage unit can be ascertained. However, the configuration may be such that the timing to perform maintenance with respect to the respective configurations of the banknote storage unit can be ascertained by performing notification according to the specific information J in the individual memory by the banknote processing device 1. For example, a notifying unit (a notification LED or the like) is provided in the banknote processing device 1. In the configuration, the control unit of the banknote processing device 1 monitors the number of drives of each individual memory. When the number of drives of each individual memory has reached a preset threshold (the number of drives that requires maintenance), this matter is notified by the notifying unit. In the above configuration, the motor speed may be monitored, and when the motor speed is equal to or less than a preset threshold, this matter may be notified by the notifying unit. Further, the measured light quantity may be monitored, and when the measured light quantity is equal to or less than a preset threshold, this matter may be notified by the notifying unit.

The paper sheet storage device according to the present invention is, for example, a control device described below.

The paper sheet storage device according to the present invention is a paper sheet storage device attached to a paper sheet processing device (1) having a storage function for receiving paper sheets transported thereto and storing the paper sheets in the paper sheet storage device (40, 60) and/or a feeding function for feeding paper sheets stored in the paper sheet storage device. The paper sheet storage device includes a memory unit (201) that memorizes therein specific information (J) to be updated according to storage or feed of paper sheets. In the configuration described above, for example, by providing a reader capable of reading the specific information from the memory unit of the paper sheet storage device (banknote storage unit) in a management room, both a work for judging necessity of maintenance of the paper sheet storage device and the maintenance of the paper sheet storage device can be performed in the management room.

REFERENCE SIGNS LIST

1 banknote processing device, 40 first banknote storage unit, 60 second banknote storage unit, 100 tape full empty sensor, 200 memory board, 201 individual memory, 202 connector

The invention claimed is:

1. A paper sheet processing device detachably equipped with a paper sheet storage device having a storage function for receiving paper sheets transported thereto and storing the paper sheets in the paper sheet storage device and/or a feeding function for feeding paper sheets stored in the paper sheet storage device, wherein the paper sheet storage device comprises a first banknote storage unit and a second banknote storage unit, wherein the second banknote storage unit stores different denominations of paper sheets from the first paper sheet storage device;

the first paper sheet storage device is detachable from the paper sheet processing device and is formed to be capable to be carried with the paper sheets stored therein, comprising a first motor unit driven when paper sheets are received in the first paper sheet storage device and/or when paper sheets are fed from the first paper sheet storage device, a first memory unit that memorizes a first sheet information indicating the denomination of paper sheets stored in the first sheet storage device and first count information indicating the number of times the first motor unit is driven, a first output unit that outputs each information stored in the first memory unit to an external device that displays a maintenance screen on which the first sheet information and the first count information are grasped;

the second paper sheet storage device is detachable from the paper sheet processing device and is formed to be capable to be carried with the paper sheets stored therein, comprising a second motor unit driven when paper sheets are received in the second paper sheet storage device and/or when paper sheets are fed from the second paper sheet storage device, a second memory unit that memorizes a second sheet information indicating the denomination of paper sheets stored in the second sheet storage device and second count information indicating the number of times the second motor unit is driven, a second output unit that outputs each information stored in the second memory unit to an external device that displays a maintenance screen on which the second sheet information and the second count information are grasped.

2. The paper sheet processing device according to claim 1, wherein the first motor unit comprises a specific motor unit driven when paper sheets of a specific denomination are received in the first paper sheet storage device and/or when paper sheets of the specific denomination are fed from the first paper sheet storage device, and a predetermined motor unit rotated when paper sheets of a predetermined denomination are received in the first paper sheet storage device and/or when paper sheets of the predetermined denomination are fed from the first paper sheet storage device, wherein the predetermined denomination is different from the specific denomination wherein the first memory unit memorizes information indicating the specific denomination and information indicating the predetermined denomination as the first sheet information, and information indicating the number of times the specific motor unit is rotated and information indicating the number of times the predetermined motor unit is rotated as the first count information.

3. The paper sheet processing device according to claim 2, a speed measuring unit that measures the rotation speed of the first motor unit and stores it in the first memory unit, and measures the rotation speed of the second motor unit and stores it in the second memory unit.

4. The paper sheet processing device according to claim 1, further comprising a speed measuring unit that measures the rotation speed of the first motor unit and stores it in the first memory unit, and measures the rotation speed of the second motor unit and stores it in the second memory unit.

* * * * *